US012752971B2

(12) United States Patent
Underwood et al.

(10) Patent No.: US 12,752,971 B2
(45) Date of Patent: Oct. 6, 2026

(54) STORAGE CASE

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 15 days.

(21) Appl. No.: 18/376,954

(22) Filed: Oct. 5, 2023

(65) Prior Publication Data

US 2024/0109692 A1 Apr. 4, 2024

Related U.S. Application Data

(60) Provisional application No. 63/411,763, filed on Sep. 30, 2022.

(51) Int. Cl.

| | |
|---|---|
| ***B65D 43/16*** | (2006.01) |
| ***B65D 1/34*** | (2006.01) |
| ***B65D 43/22*** | (2006.01) |
| ***B65D 55/02*** | (2006.01) |

(52) U.S. Cl.

CPC ..... *B65D 43/165* (2013.01); *B65D 1/34* (2013.01); *B65D 43/22* (2013.01); *B65D 55/02* (2013.01); *B65D 2251/1058* (2013.01); *B65D 2543/00194* (2013.01); *B65D 2543/00296* (2013.01); *B65D 2555/02* (2013.01)

(58) Field of Classification Search

CPC ..... B65D 43/165; B65D 1/34; B65D 43/22; B65D 55/02; B65D 2251/1058; B65D 2543/00194; B65D 2543/0029; B65D 2543/2555; B65D 2543/02

USPC ..... 220/833, 4.22, 4.24

See application file for complete search history.

(56) References Cited

U.S. PATENT DOCUMENTS

| | | | | |
|---|---|---|---|---|
| 4,576,307 | A * | 3/1986 | Frydenberg | A45C 13/10 190/117 |
| 5,370,254 | A * | 12/1994 | Hardigg | E05D 9/005 220/325 |
| 5,655,677 | A * | 8/1997 | Fratello | B65G 51/06 406/186 |
| 7,546,920 | B1 * | 6/2009 | Horn | F41C 33/06 206/317 |
| 8,573,715 | B1 * | 11/2013 | Jackman | A47K 10/32 49/382 |
| 9,884,702 | B1 * | 2/2018 | Burns | A63C 11/00 |
| 10,604,320 | B1 * | 3/2020 | Robinson | B65D 25/2802 |
| 11,435,161 | B2 | 9/2022 | Searle et al. | |
| 12,225,966 | B2 * | 2/2025 | Ellis | A61B 5/112 |
| 2006/0290492 | A1 * | 12/2006 | Jidas | G08B 13/08 340/545.6 |
| 2009/0314674 | A1 * | 12/2009 | Sauerheber | B25H 3/021 206/373 |

(Continued)

FOREIGN PATENT DOCUMENTS

| | | | | |
|---|---|---|---|---|
| WO | WO-2023172351 | A1 * | 9/2023 | A45C 13/02 |

*Primary Examiner* — Orlando E Aviles
*Assistant Examiner* — Niki M Eloshway

(57) ABSTRACT

A storage case assembly includes a first member with at least one male hinge member and at least one female hinge member; a second member with at least one male hinge member and at least one female hinge member; and at least one latch member that connects the first member and the second member, wherein the first member and the second member are identical.

20 Claims, 24 Drawing Sheets

(56) References Cited

U.S. PATENT DOCUMENTS

| | | | | |
|---|---|---|---|---|
| 2012/0193353 | A1* | 8/2012 | Cronin | A45C 13/005<br>29/434 |
| 2020/0189812 | A1* | 6/2020 | Hice | B65D 50/04 |
| 2020/0191522 | A1 | 6/2020 | Searle et al. | |
| 2021/0080224 | A1 | 3/2021 | Searle et al. | |
| 2025/0059592 | A1* | 2/2025 | Cai | C12Q 1/682 |

* cited by examiner

STORAGE CASE

CROSS REFERENCE TO RELATED APPLICATION

This application is related to and claims priority benefit from U.S. Provisional Application No. 63/411,763 ("the '763 application"), filed on Sep. 30, 2022. The '763 application is hereby incorporated in its entirety by this reference.

FIELD OF THE INVENTION

The field of the invention relates to storage cases, particularly polymer storage cases and related manufacturing methods.

BACKGROUND

Many modern products (including camera equipment, firearms, electronic equipment, etc.) are fragile and require a durable and robust case for travel, storage, etc. For example, many people travel to remote locations for filming or photography and need case(s) for transporting sensitive film and camera equipment. In addition, people often travel with firearms, for competition, hunting, or other purposes, and require case(s) for firearms. Existing storage cases are often either (i) too flexible and delicate such that they do not provide sufficient protection for the contents or (ii) too heavy and overly expensive such that they are cost prohibitive and not well suited to traveling.

To provide an ideal balance between weight and strength while maximizing manufacturing efficiency, reducing costs, and simplifying assembly, it may be desirable to design new storage case assemblies.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments of the present invention, a storage case assembly comprises: a first member comprising at least one male hinge member and at least one female hinge member; a second member comprising at least one male hinge member and at least one female hinge member; and at least one latch member that connects the first member and the second member, wherein the first member and the second member are identical.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In some embodiments, a storage case assembly 100 includes a first member 101, a second member 102, and at least one latch member 150 (see FIGS. 1-12C). The first member 101 may include a floor 101*a* and a plurality of walls 101*b*. Similarly, the second member 102 may include a floor 102*a* and a plurality of walls 102*b*. In some embodiments, the walls 101*b*, 102*b* are perpendicular to the respective floor 101*a*, 102*a* while, in other cases, the walls 101*b*, 102*b* are oblique to the respective floor 101*a*, 102*a*. For example, to accommodate ejection molding polymer tooling, the walls 101*b*, 102*b* may include draft (and are oblique) relative to the respective floor 101*a*, 102*a*.

Figure 1:
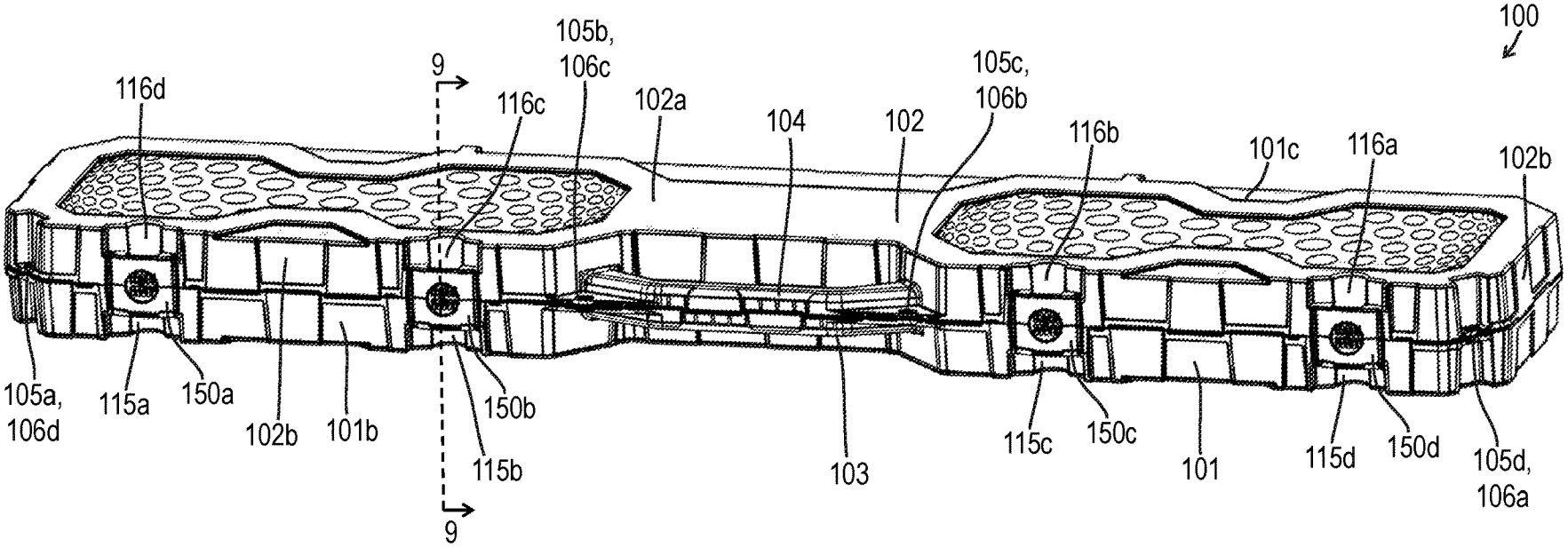
FIG. 1 is a front perspective view of a storage case assembly according to certain embodiments of the present invention.
Figure 2:
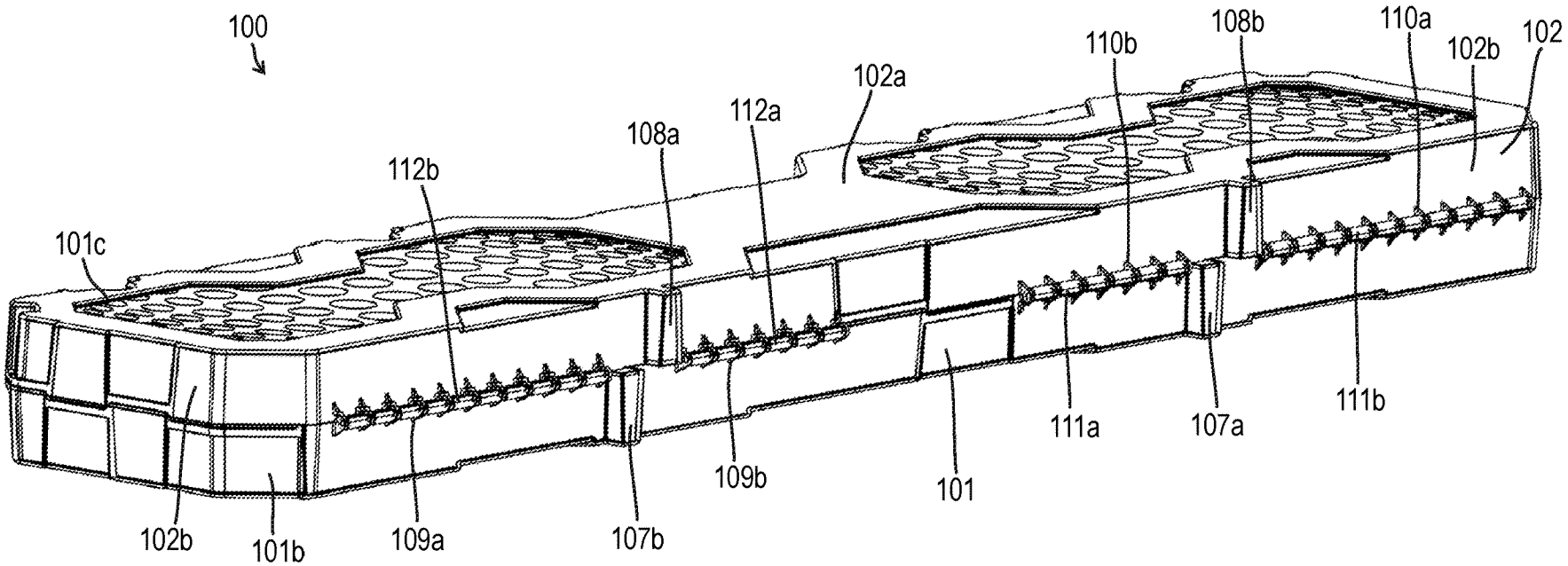
FIG. 2 is a rear perspective view of the storage case assembly of FIG. 1.
Figure 3:
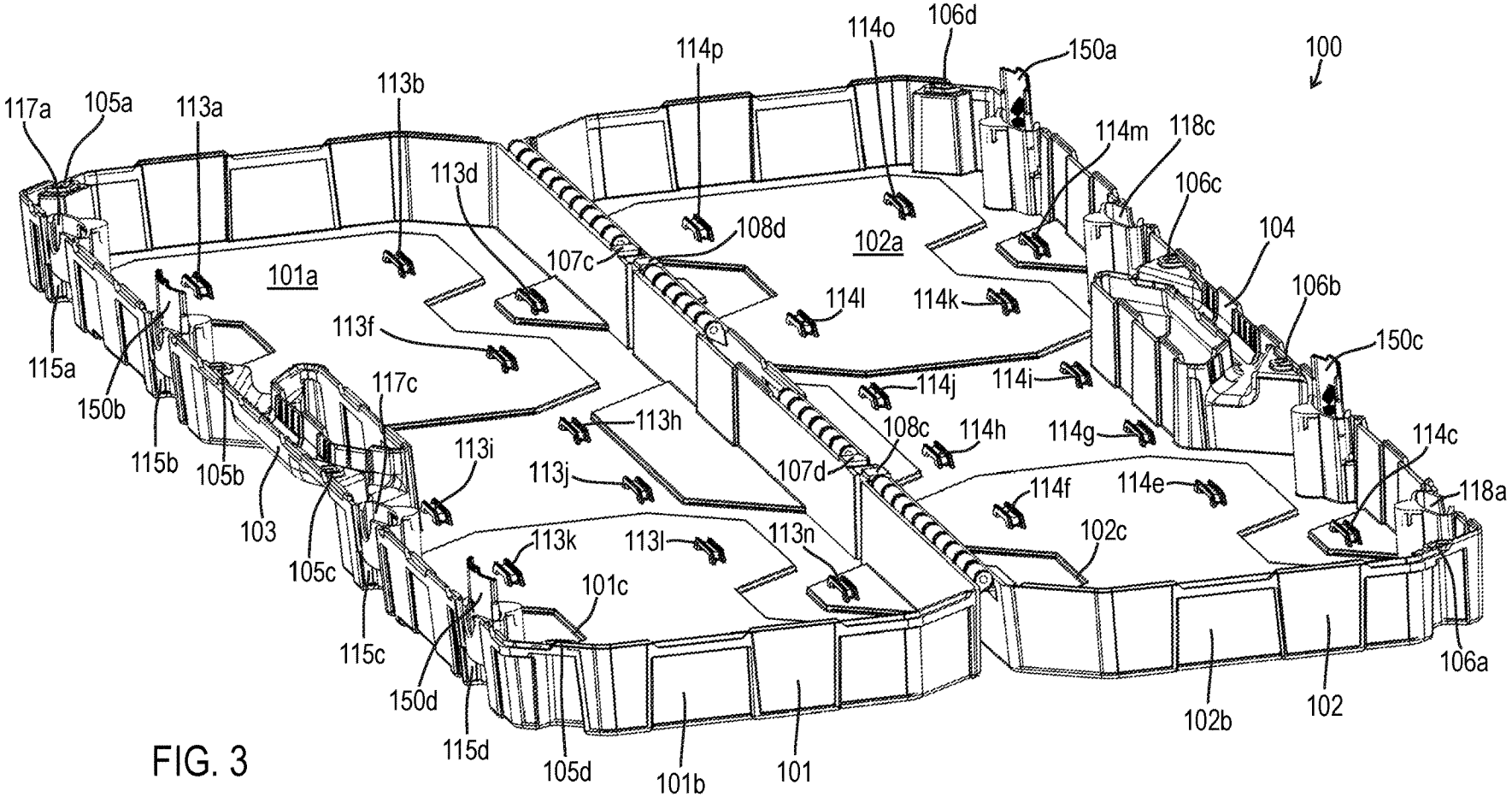
FIG. 3 is a front perspective view of the storage case assembly of FIG. 1 in an open configuration.
Figure 12A:
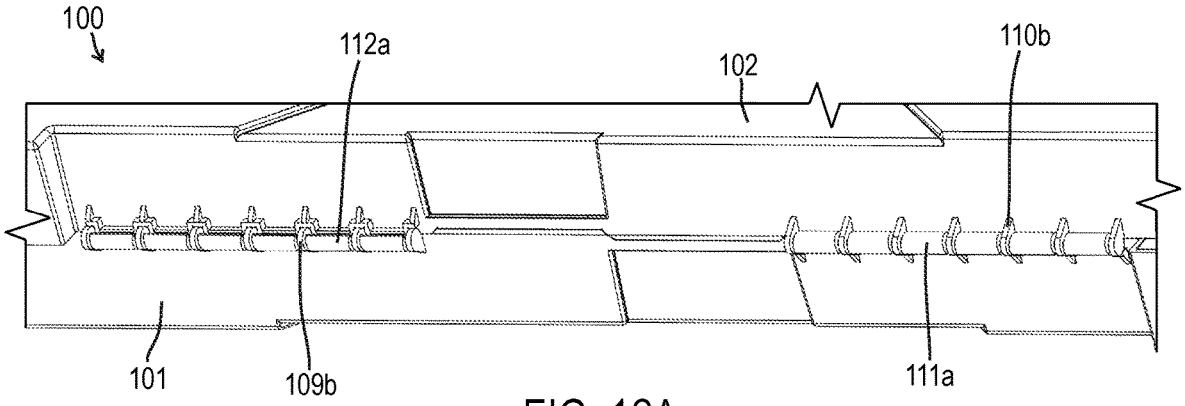
FIG. 12A is a rear perspective view of hinge members of the storage case assembly of FIG. 1.
Figure 12B:
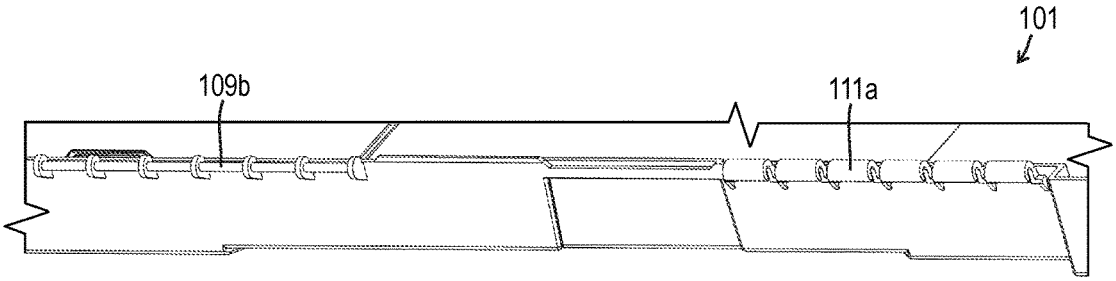
FIG. 12B is a rear perspective view of hinge members of the first member of the storage case assembly of FIG. 1.
Figure 12C:
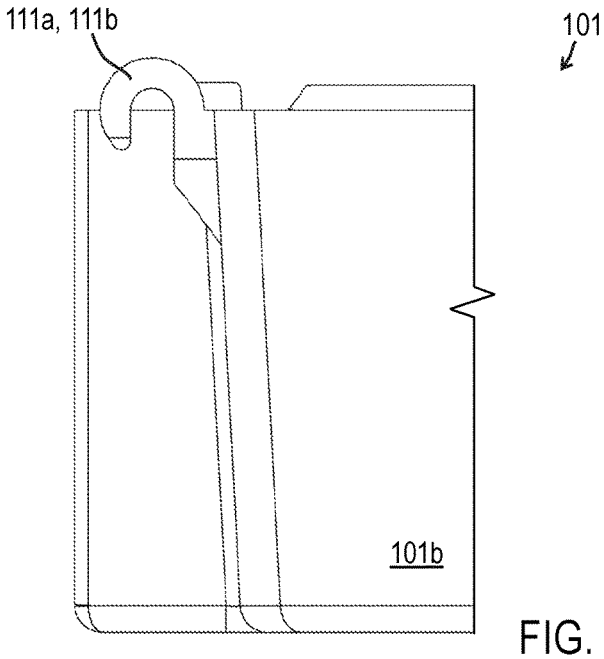
FIG. 12C is a side view of a hinge member of FIG. 12B.

As shown in FIGS. 1-3, the first member 101 and the second member 102 may be identical. In other words, when the storage case assembly 100 includes polymer components, a single mold or tool may produce each side of the storage case assembly 100 to maximize manufacturing efficiency. The height of the walls 101*b* may be equal to the height of the walls 102*b*. As shown in FIGS. 2, 5, 12A, and 12B, the first member 101 may include at least one male hinge member 109*a*, 109*b* and at least one female hinge member 111*a*, 111*b*. Similarly, the second member 102 may include at least one male hinge member 110*a*, 110*b* and at least one female hinge member 112*a*, 112*b*. Based on this arrangement of identical halves, as shown in FIG. 2, the male hinge member 109*a* interfaces with female hinge member 112*b*, the male hinge member 109*b* interfaces with female hinge member 112*a*, the female hinge member 111*a* interfaces with male hinge member 110*b*, and the female hinge member 111*b* interfaces with male hinge member 110*a*. FIG. 12A shows both the first member 101 and the second member 102 in an embodiment where the male hinge member 109*b* is engaged with female hinge member 112*a* and the male hinge member 110*b* is engaged with female hinge member 111*a*. FIG. 12B shows a similar view of only the first member 101. In some embodiments, as shown in FIG. 12C, the at least one female hinge member 111*a*, 111*b* may include an opening with straight walls for interfacing with the corresponding male hinge members.

Figure 5:
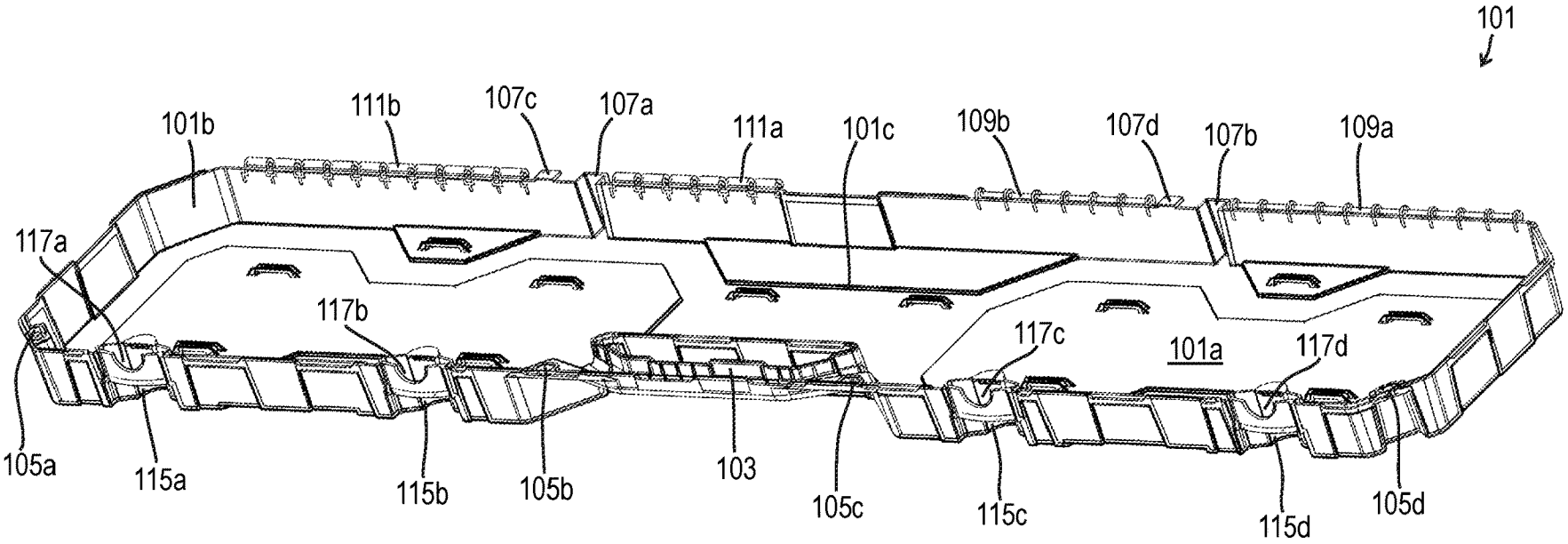
FIG. 5 is a front perspective view of a first member of the storage case assembly of FIG. 1.

The first member 101 may include at least one foot member 107 and the second member 102 may include at least one foot member 108, as shown in FIGS. 2 and 5. In some embodiments, the first member 101 includes a first foot member 107*a* and a second foot member 107*b*. Similarly, the second member 102 may include a first foot member 108*a* and a second foot member 108*b*. In some embodiments, because the first member 101 and the second member 102 are identical (as described above), first foot member 107*a* is identical to first foot member 108*a* and second foot member 107*b* is identical to second foot member 108*b*. The feet members 107, 108 may be designed to hold the storage case assembly 100 on its edge (i.e., when the hinge members 109-112 face down and the handle portions 103, 104 face up). In some embodiments, the first member 101 includes at least one tab 107*c*, 107*d* that corresponds to the locations of the at least one foot member 108*a*, 108*b* of the second member 102. Similarly, the second member 102 may include at least one tab 108*c*, 108*d* that corresponds to the locations of the at least one foot member 107*a*, 107*b* of the first member 101. The tabs 107*c*, 107*d*, 108*c*, 108*d* may be designed to close the opening of the respective foot member when the storage case assembly 100 is in the closed configuration.

In some cases, the floor 101*a* of the first member 101 includes surfaces on multiple parallel planes with connecting walls 101*c* connecting the various surfaces. In some cases, the connecting walls 101*c* are perpendicular to the surfaces of the floor 101*a* while, in other cases, the connecting walls 101*c* are oblique to the surfaces of the floor 101*a* (see FIG. 7). Similarly, the floor 102*a* of the second member 102 may include surfaces on multiple parallel planes with connecting walls 102*c* connecting the various surfaces.

Figure 11:
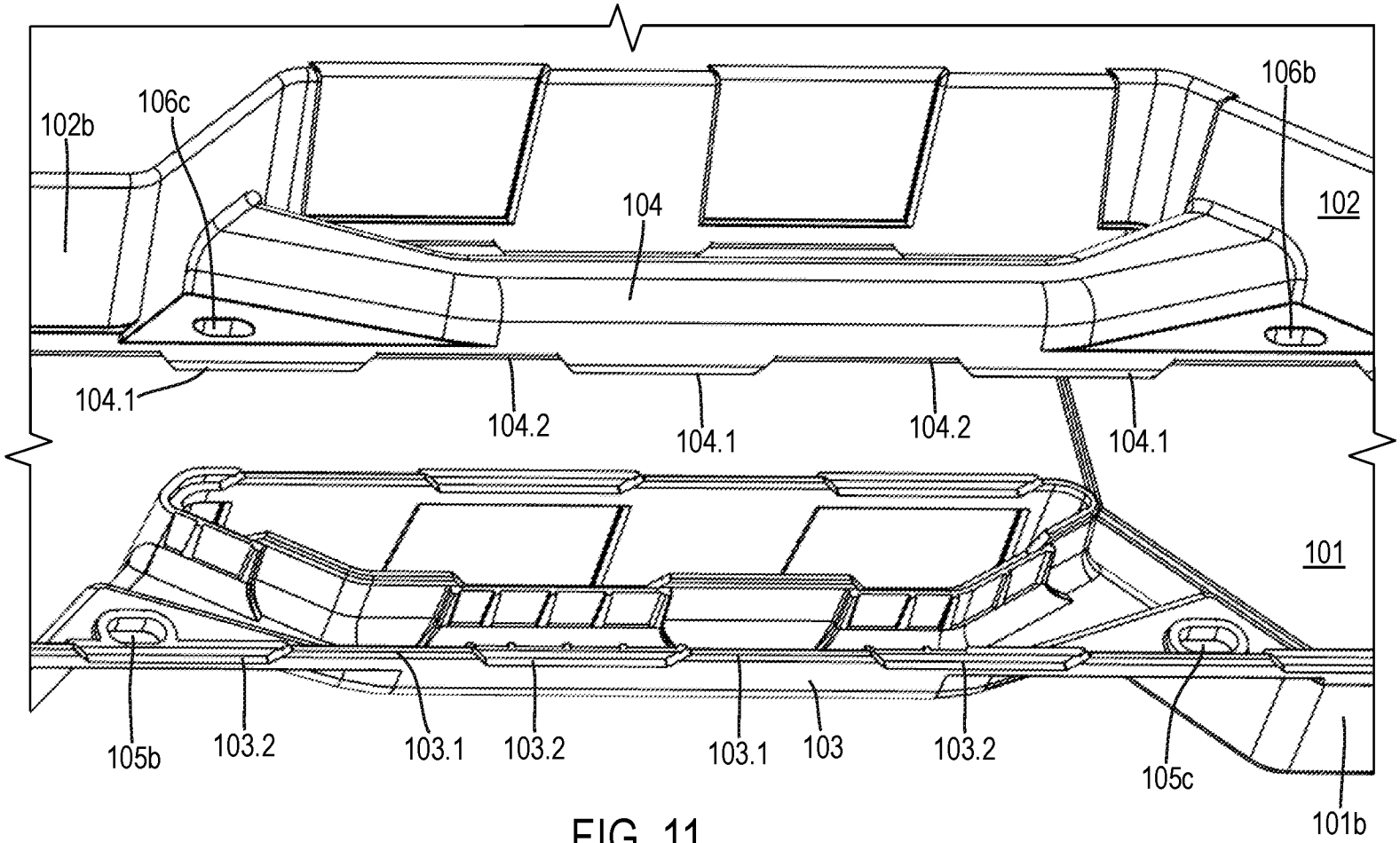
FIG. 11 is a partial perspective view of a handle portions of the storage case assembly of FIG. 1 in a partially open configuration.

As shown in FIGS. 1, 3, 10, and 11, the first member 101 may include a handle portion 103 and the second member 102 may include a handle portion 104. As discussed above, in some embodiments, the first member 101 and the second member 102 are identical such that the handle portion 103 and the handle portion 104 are identical and are designed such that corresponding features engage one another when the members 101, 102 are attached to one another. The handle portions 103, 104 may include an array of teeth and corresponding notches. For example, the handle portion 103 may include teeth 103.1 and notches 103.2 while the handle portion 104 may include teeth 104.1 and notches 104.2. As shown in FIG. 11, which shows a partial view of the storage case assembly 100 partially open, the teeth 103.1 engage the notches 104.2 and the teeth 104.1 engage the notches 103.2.

Figure 6:
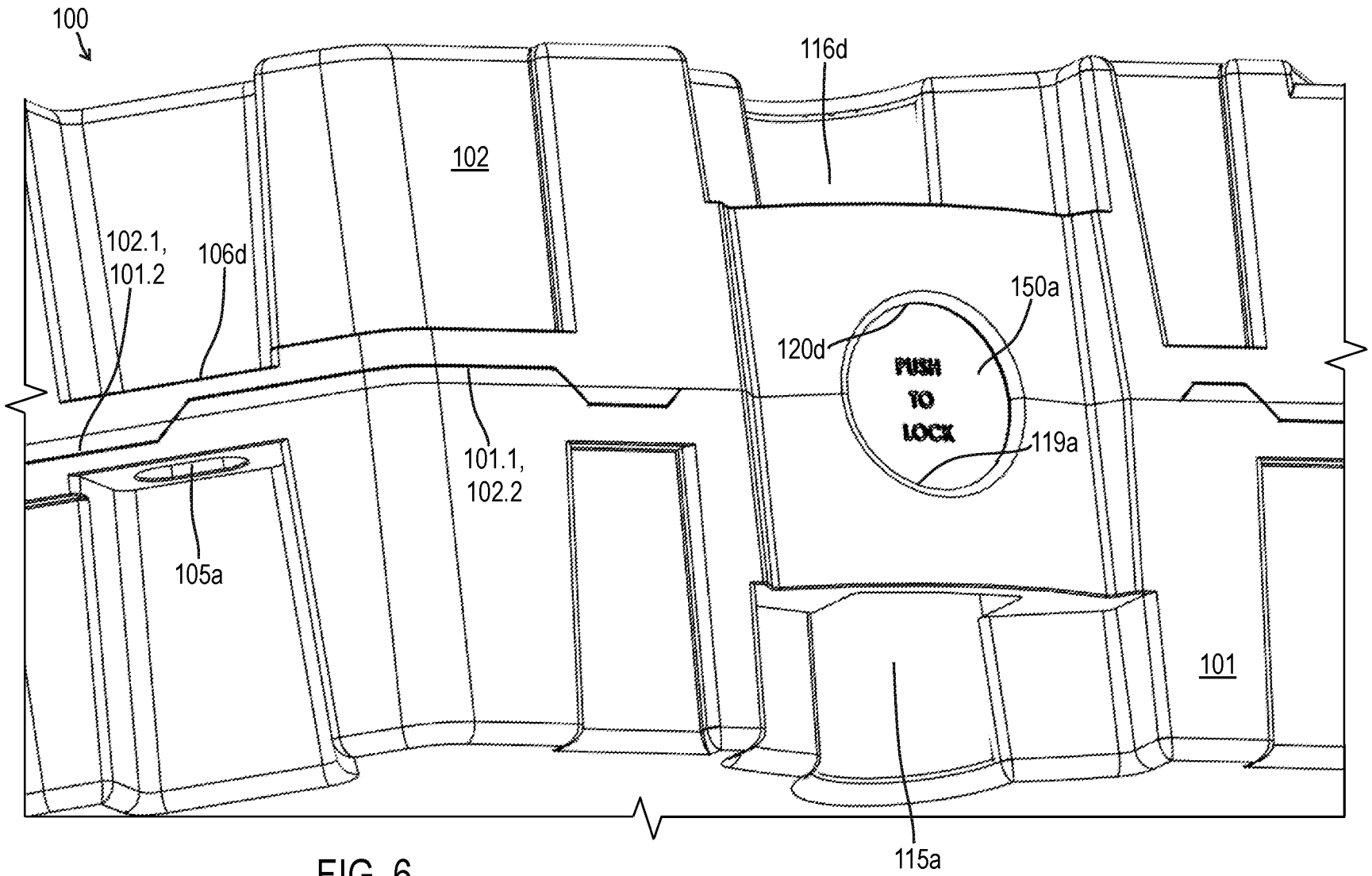
FIG. 6 is a detail partial perspective view of the storage case assembly of FIG. 1.
Figure 7A:
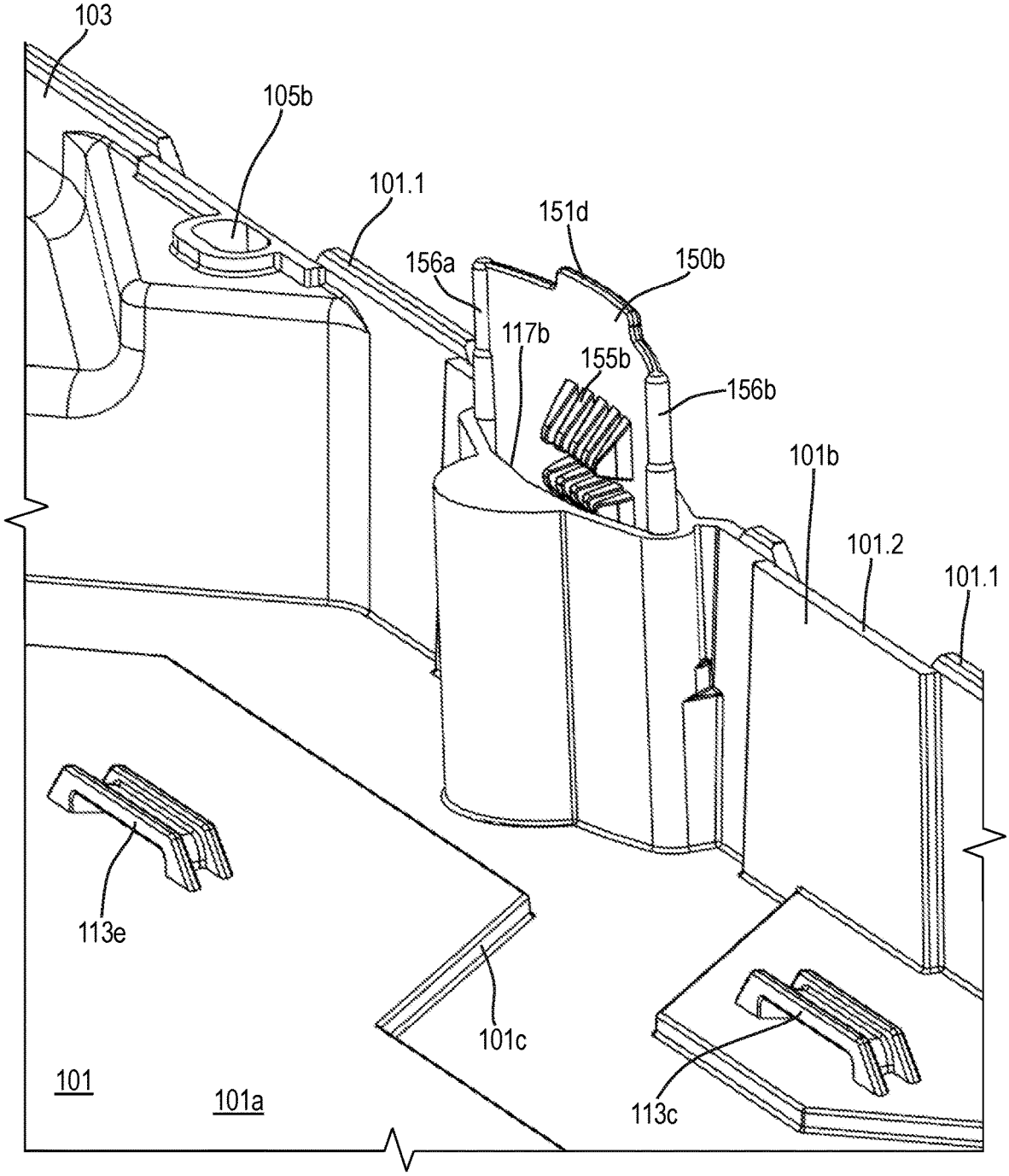
FIG. 7A is an internal partial perspective view of the storage case assembly of FIG. 1.
Figure 7B:
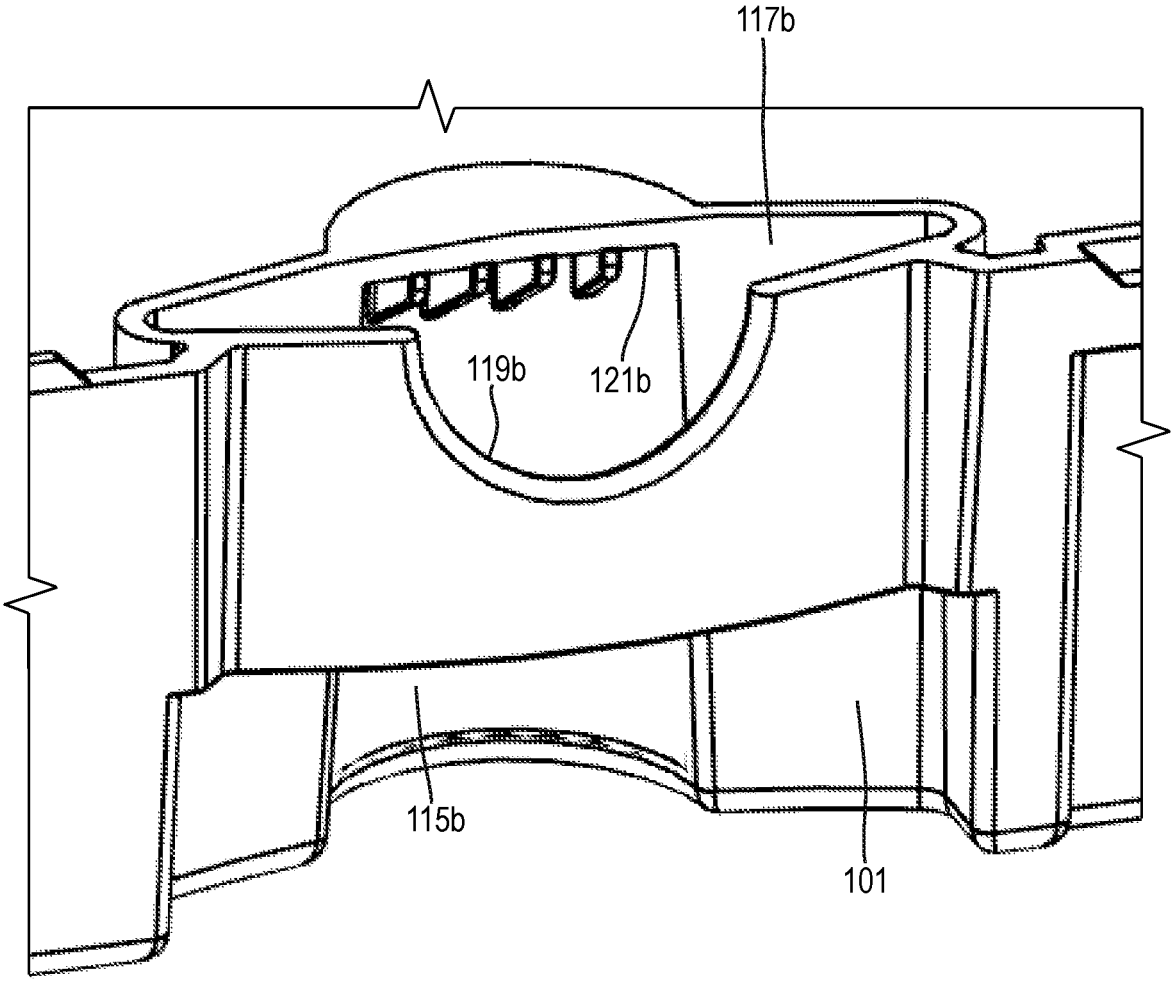
FIG. 7B is an external partial perspective view of the storage case assembly of FIG. 1.

Similar to the handle portions 103, 104, in some cases, the other portions of the first member 101 and the second member 102 may include an array of teeth and corresponding notches. For example, as shown in FIGS. 6 and 7, the first member 101 may include teeth 101.1 and notches 101.2 while the second member 102 may include teeth 102.1 and notches 102.2. The teeth 101.1, 102.1, 103.1, 104.1 and notches 101.2, 102.2, 103.2, 104.2 (*i*) may augment engagement and sealing between the corresponding portions of the first member 101 and the second member 102, (ii) may aid in alignment between the first member 101 and the second member 102, (iii) may increase rigidity/strength of the storage case assembly 100, and/or (iv) may provide various other benefits.

As shown in FIGS. 3, 5, 7, and 8, the storage case assembly 100 may include a plurality of strap lugs 113, 114. In some cases, the first member 101 includes 16 strap lugs 113*a*-113*p* and the second member 102 includes 16 strap lugs 114*a*-114*p*. In some embodiments, the first member 101 includes 12 strap lugs 113 and the second member 102 includes 12 strap lugs 114. In some cases, the first member 101 does not include strap lugs 113*g*-113*j* and the second member 102 does not include strap lugs 114*g*-114*j*. The storage case assembly 100 may include as few as zero or as many as 100 strap lugs. In some embodiments, the first member 101 includes 10 strap lugs 113 and the second member 102 includes 10 strap lugs 114. In some embodiments, the first member 101 includes 8 strap lugs 113 and the second member 102 includes 8 strap lugs 114. In some embodiments, the first member 101 includes 6 strap lugs 113 and the second member 102 includes 6 strap lugs 114. In some embodiments, the first member 101 includes 14 strap lugs 113 and the second member 102 includes 14 strap lugs 114. In some embodiments, the first member 101 includes 18 strap lugs 113 and the second member 102 includes 18 strap lugs 114. In some embodiments, the first member 101 includes 20 strap lugs 113 and the second member 102 includes 20 strap lugs 114.

The latch member(s) 150 may each engage a respective recess of the first member 101 and/or the second member 102. For example, as shown in FIGS. 7A-8C, latch member 150*b* may be disposed within recess 117*b* of the first member 101 and within recess 118*c* of the second member 102. The first member 101 may include a cavity 115 that allows a user to manipulate or actuate an upper or lower edge of the latch member 150. Similarly, the second member 102 may include a cavity 116 that allows a user to manipulate or actuate an upper or lower edge of the latch member 150. As shown in FIGS. 1, 3, and 5, the storage case assembly 100 may include four latch members 150*a*-150*d*. However, the storage case assembly 100 may include any appropriate number of latch members 150. For example, the storage case assembly 100 may be configured with an additional latch member 150 at each end of the storage case assembly 100 such that the storage case assembly 100 includes six latch members 150. The storage case assembly 100 may be configured with more or fewer latch members 150, which includes (but is not limited to) configurations where the storage case assembly 100 is longer or shorter than the illustrative embodiments shown in the drawings.

Figure 4A:
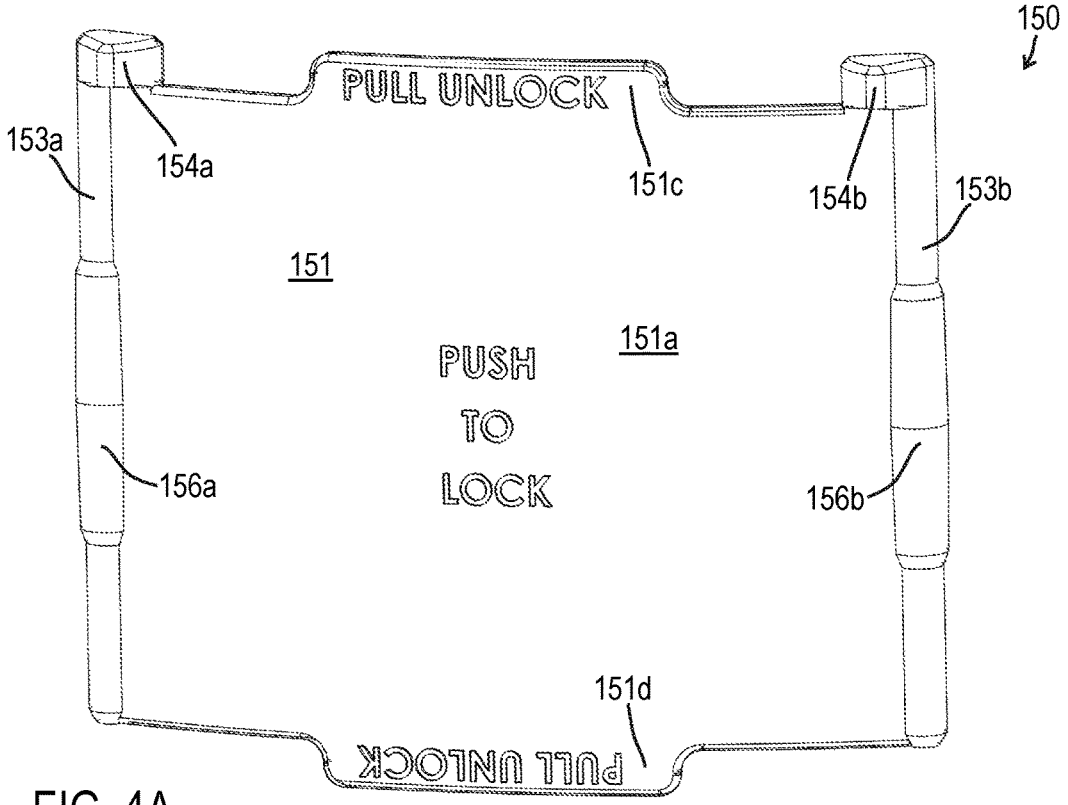
FIG. 4A is a front perspective view of a latch member of the storage case assembly of FIG. 1.
Figure 4B:
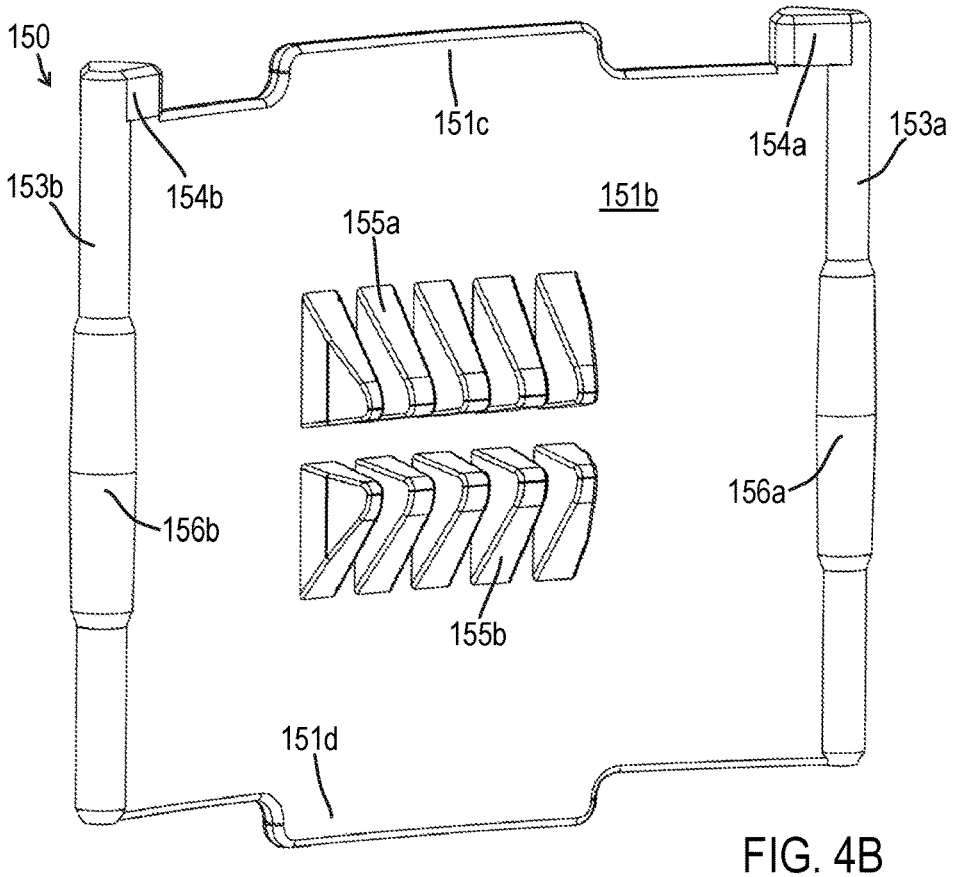
FIG. 4B is a rear perspective view of the latch member of FIG. 4A.

As shown in FIGS. 4A and 4B, each latch member 150 may include a panel portion 151, a first column 153*a*, and a second column 153*b*. The panel portion 151 may include an outer surface 151*a*, an inner surface 151*b*, an upper edge 151*c*, and a lower edge 151*d*. The first column 153*a* may include a head 154*a* at the upper end and an enlarged portion 156*a*. Similarly, the second column 153*b* may include a head 154*b* at the upper end and an enlarged portion 156*b*. In some embodiments, the enlarged portion 156 includes a conical transition from the surrounding portions of the column 153. The outer surface 151*a* may include at least one label or indicator for a user. The inner surface 151*b* may include at least one protrusion 155. For example, as shown in FIG. 4B, the inner surface 151*b* may include a first protrusion 155*a* and a second protrusion 155*b*. In some embodiments, the outer surface 151*a* includes a label, a symbol, or other instruction to indicate that pushing on the center of the panel portion 151 will cause the latch member 150 to move into a locked configuration. As shown in FIG. 6, the first member 101 may include an opening 119 and the second member 102 may include a corresponding opening 120 that together create a window for displaying the symbol or other instruction at the center of the panel portion 151 (as described above). The outer surface 151*a* may also include a label, a symbol, or other instruction to indicate that pulling on the upper edge 151*c* and/or the lower edge 151*d* of the panel portion 151 will cause the latch member 150 to move into an unlocked configuration.

Figure 8A:
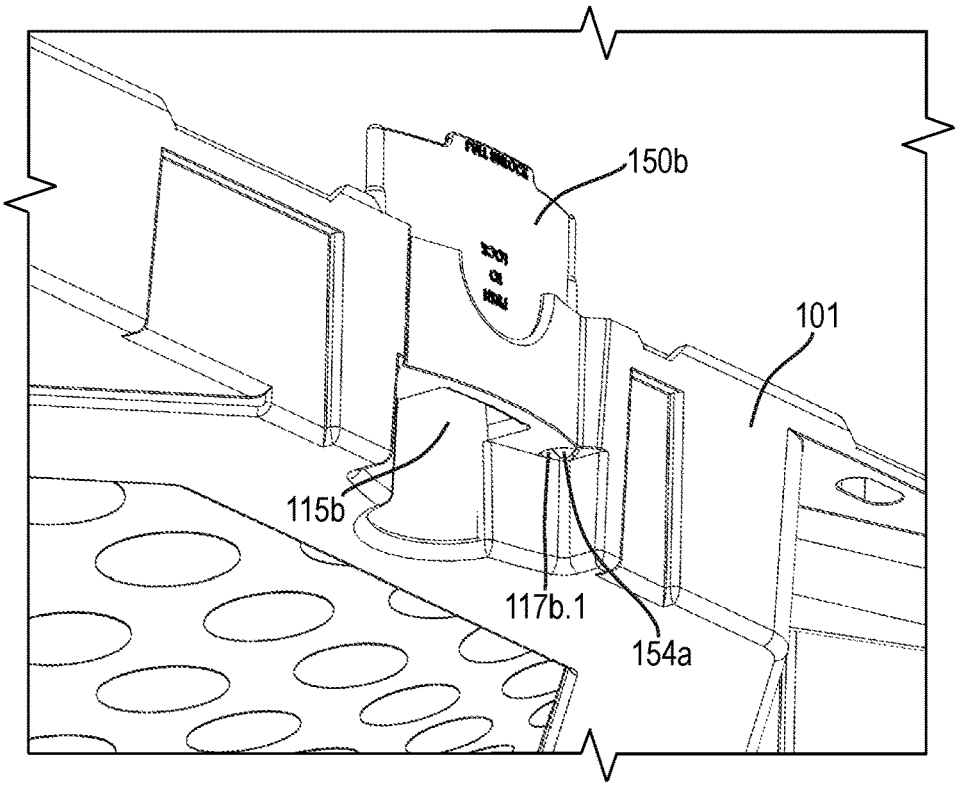
FIG. 8A is an external partial perspective view of the storage case assembly of FIG. 1.
Figure 8B:
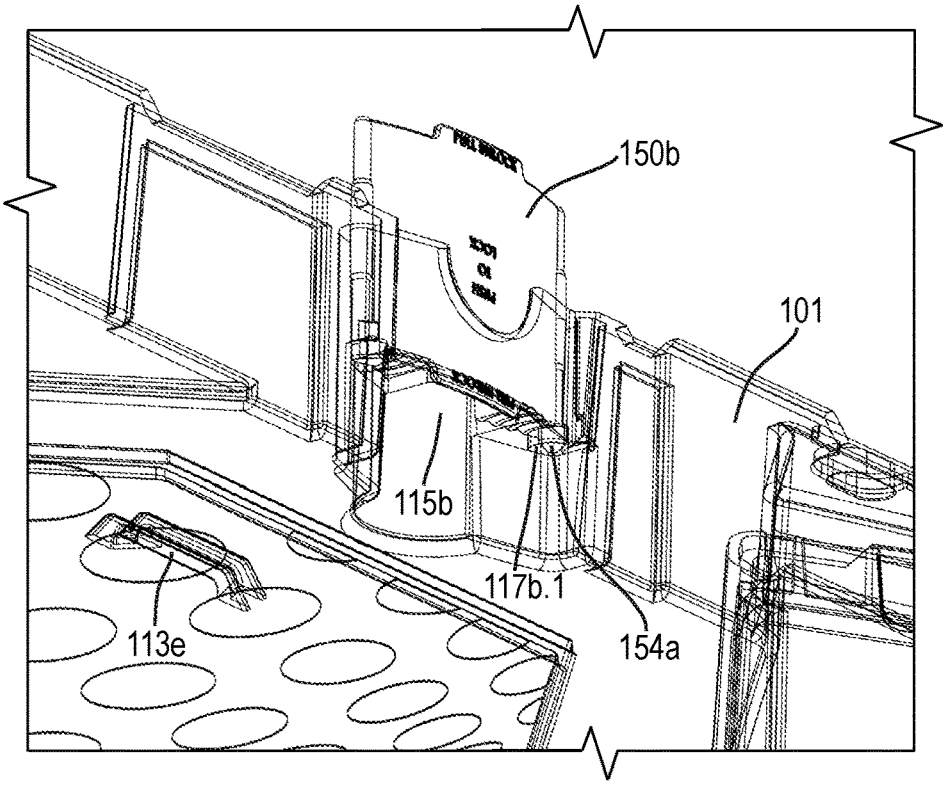
FIG. 8B is an external partial perspective view of the storage case assembly of FIG. 1 with the first member shown transparent.
Figure 8C:
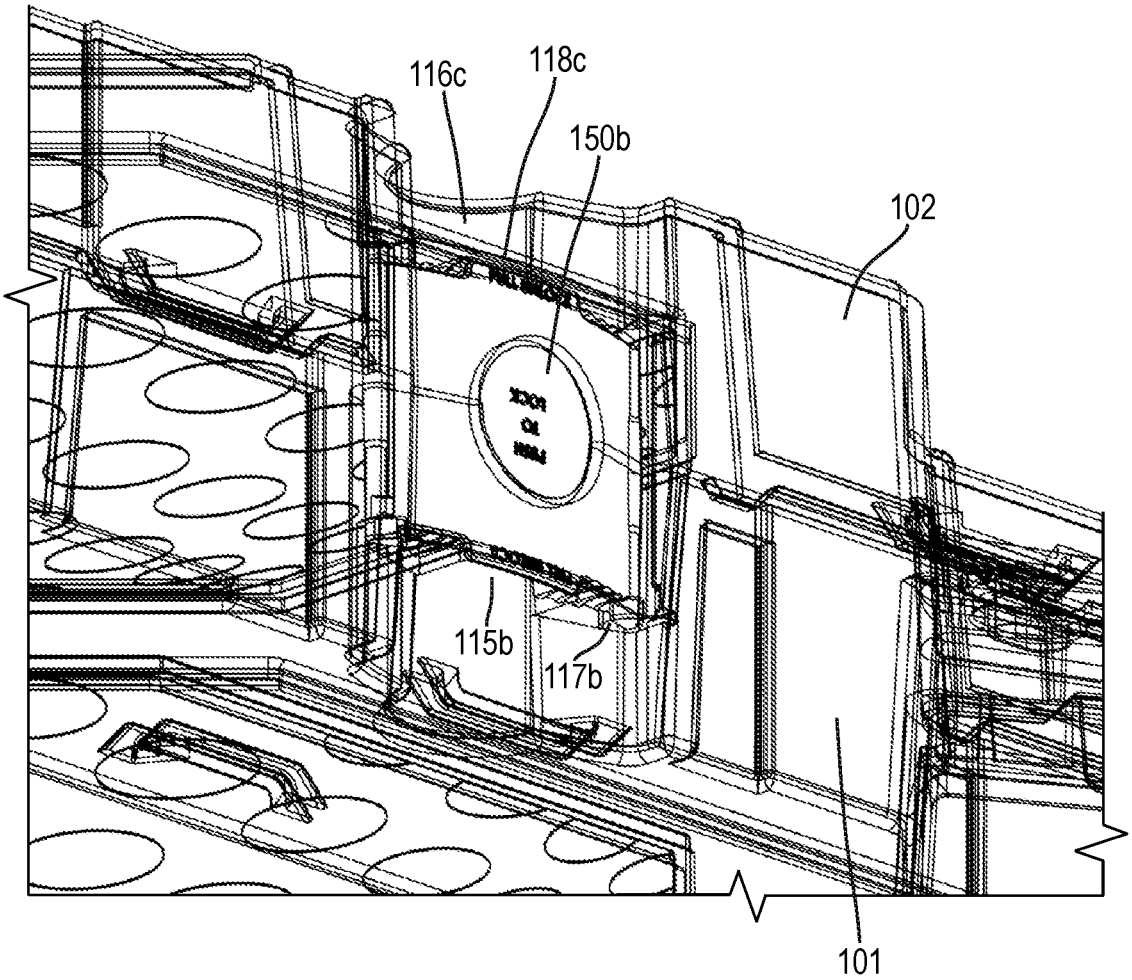
FIG. 8C is an external partial perspective view of the storage case assembly of FIG. 1 with the first and second members shown transparent.

In some embodiments, the first member 101 includes provisions for engaging a latch member 150 such that the latch member 150 cannot be easily disengaged or removed from the first member 101. For example, the head 154*a* and head 154*b* of the latch member 150 may each engage a respective cavity within the recess 117 of the of the first member 101. As one example, as shown in FIGS. 8A and 8B, the head 154*a* of latch member 150*b* engages cavity 117*b*.1 of recess 117*b*. The head 154*b* engages a similar cavity of recess 117*b*. As shown in FIG. 3, latch member 150*d* engages similar corresponding features in recess 117*d*. In some embodiments, because the first member 101 and the second member 102 are identical (as described above), latch member 150*a* engages similar corresponding features in recess 118*d* of the second member 102 and latch member 150*c* engages similar corresponding features in recess 118*b* of the second member 102 (see FIG. 3).

Figure 9A:
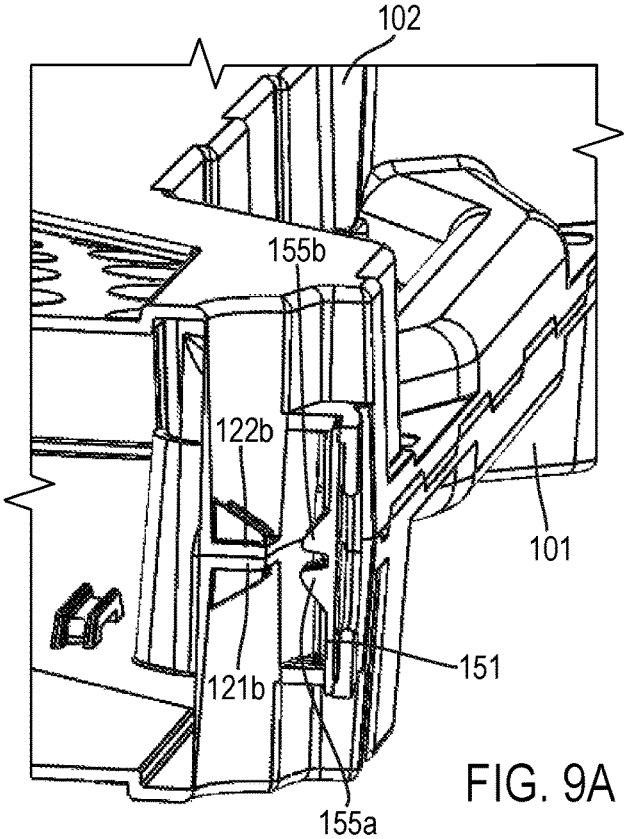
FIG. 9A is a section view of the storage case assembly of FIG. 1 with a latch member in an unlocked configuration.
Figure 9B:
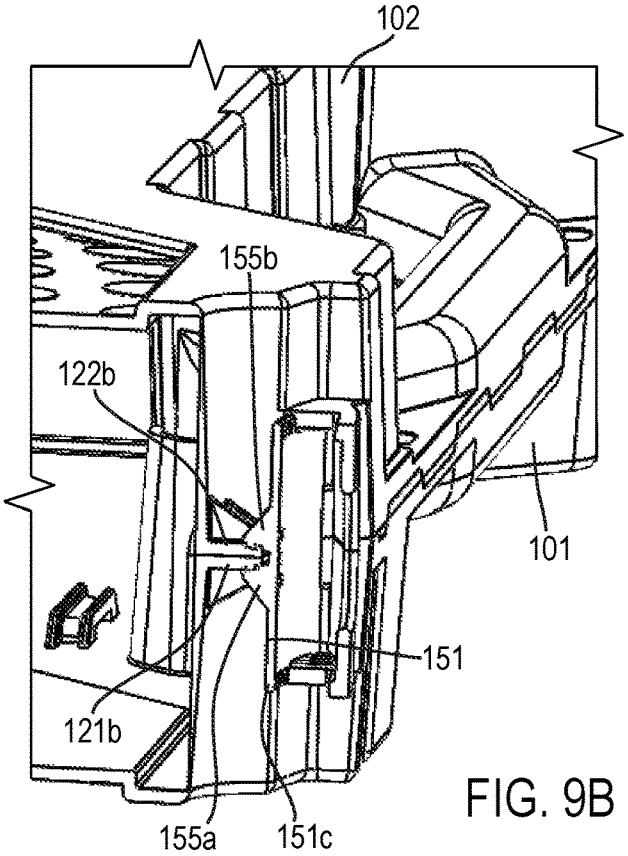
FIG. 9B is a section view of the storage case assembly of FIG. 1 with a latch member in a locked configuration.
Figure 10:
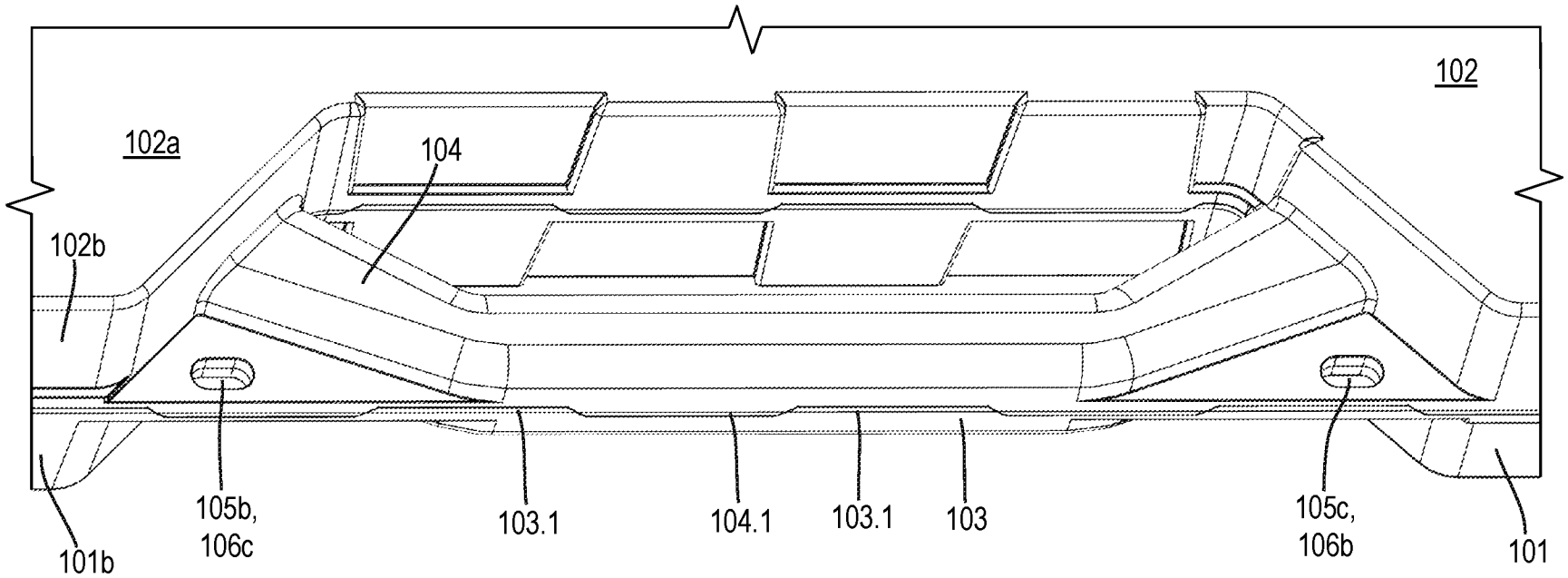
FIG. 10 is a partial perspective view of a handle portions of the storage case assembly of FIG. 1.

Function of the latch member(s) 150 may be based on deflection of the panel portion 151 between the unlocked configuration (see FIG. 9A) and the locked configuration (see FIG. 9B) such that the first column 153*a* and the second column 153*b* are held in a static configuration. FIG. 7A shows one example of the latch member 150*b* in the unlocked configuration. When the user presses the panel portion 151 to move the latch member 150 from the unlocked configuration to the locked configuration, the panel portion 151 deflects relative to the columns 156 such that the at least one protrusion 155 moves toward and engages edge 121 at the end of cavity 115. FIG. 9B shows first protrusion 155*a* of latch member 150*b* engaging edge 121*b* of the first member 101 and second protrusion 155*b* of latch member 150*b* engaging edge 122*b* of the second member 102. In some embodiments, to move the latch member 150*b* out of the locked configuration shown in FIG. 9B, the user would pull on edge 151*c*.

The storage case assembly 100 may include a plurality of mating hasps configured for a lock or padlock to secure the case in the closed configuration. For example, as shown in FIGS. 1, the first member 101 may include four hasps 105*a*-105*d* and the second member 102 may include four hasps 106*a*-106*d*. When the storage case assembly 100 is in the closed configuration (see FIGS. 1 and 2), the hasp 105*a* engages with hasp 106*d*, the hasp 105*b* engages with hasp 106*c*, the hasp 105*c* engages with hasp 106*b*, and the hasp 105*d* engages with hasp 106*a*. The storage case assembly 100 may include as few as zero or as many as 100 hasps. In some embodiments, because the first member 101 and the second member 102 are identical (as described above), hasp 105*a* is identical to hasp 106*a*, hasp 105*b* is identical to hasp 106*b*, hasp 105*c* is identical to hasp 106*c*, and hasp 105*d* is identical to hasp 106*d*.

Figure 13:
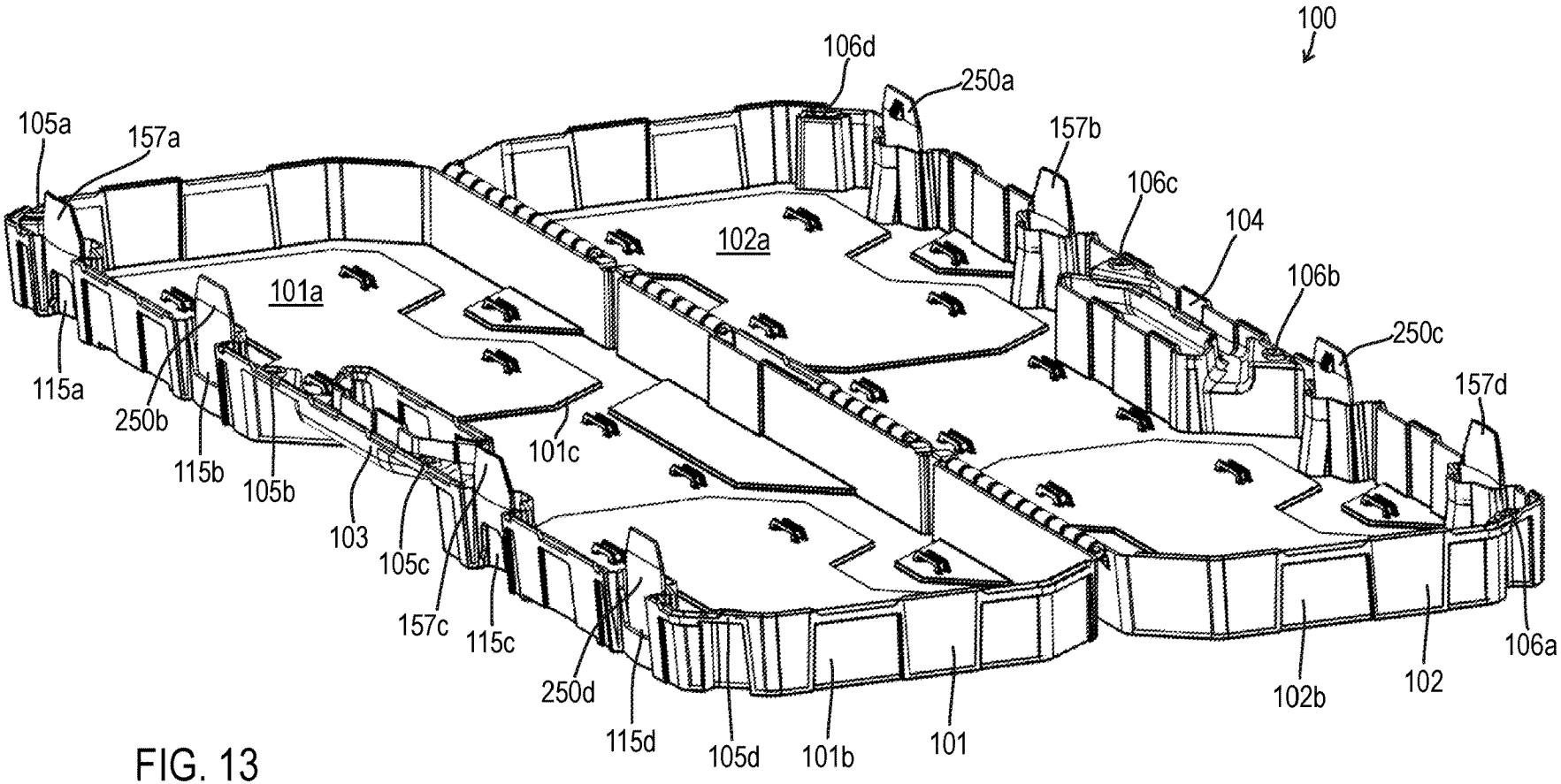
FIG. 13 is a front perspective view of the storage case assembly of FIG. 1 in an open configuration.
Figure 14A:
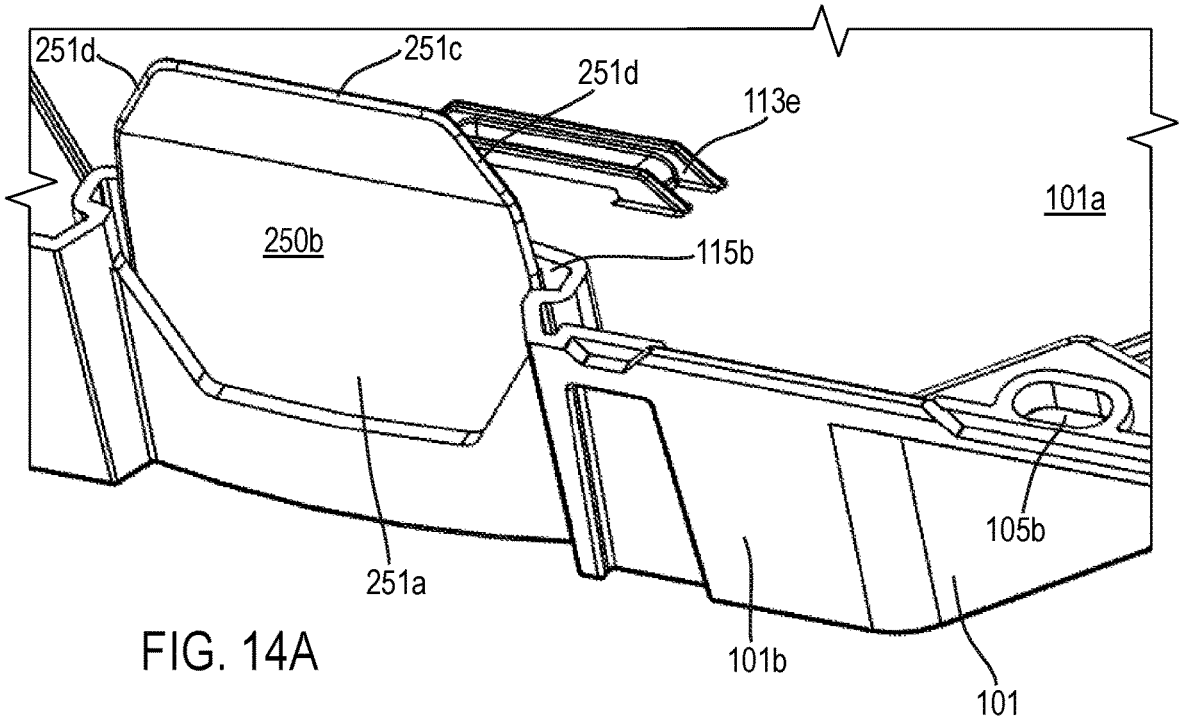
FIG. 14A is an external partial perspective view of a latch member of the storage case assembly of FIG. 13.
Figure 14B:
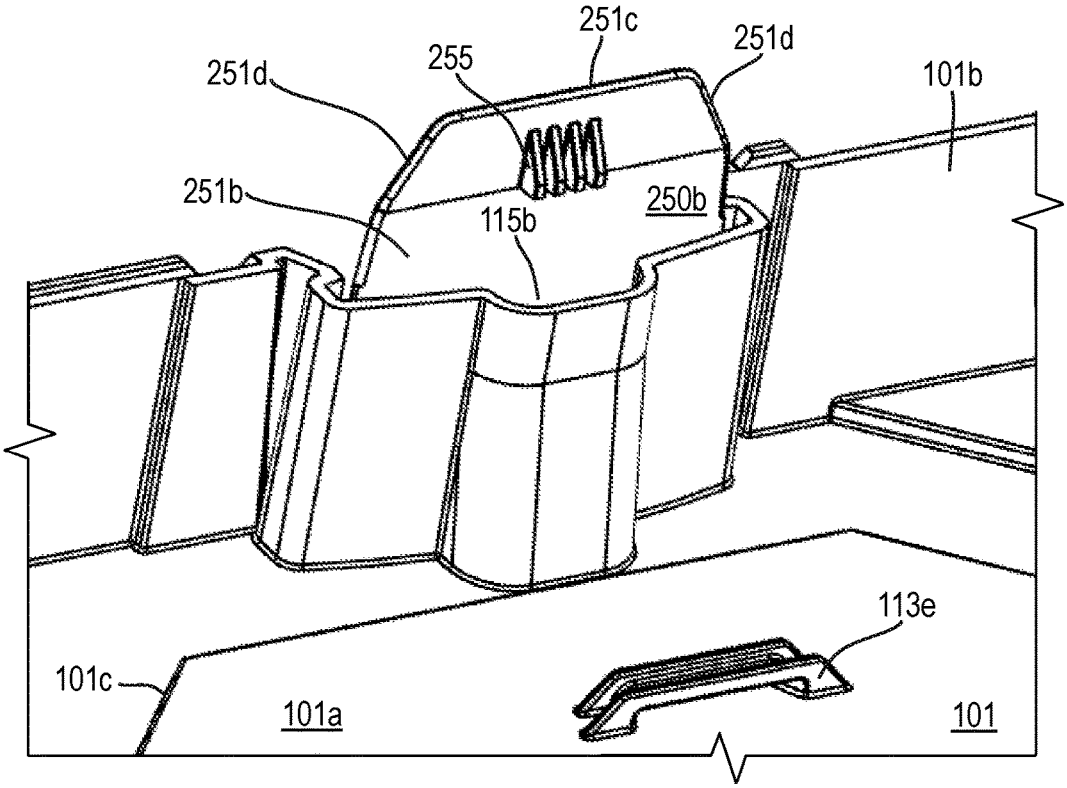
FIG. 14B is an internal partial perspective view of a latch member of the storage case assembly of FIG. 13.
Figure 14C:
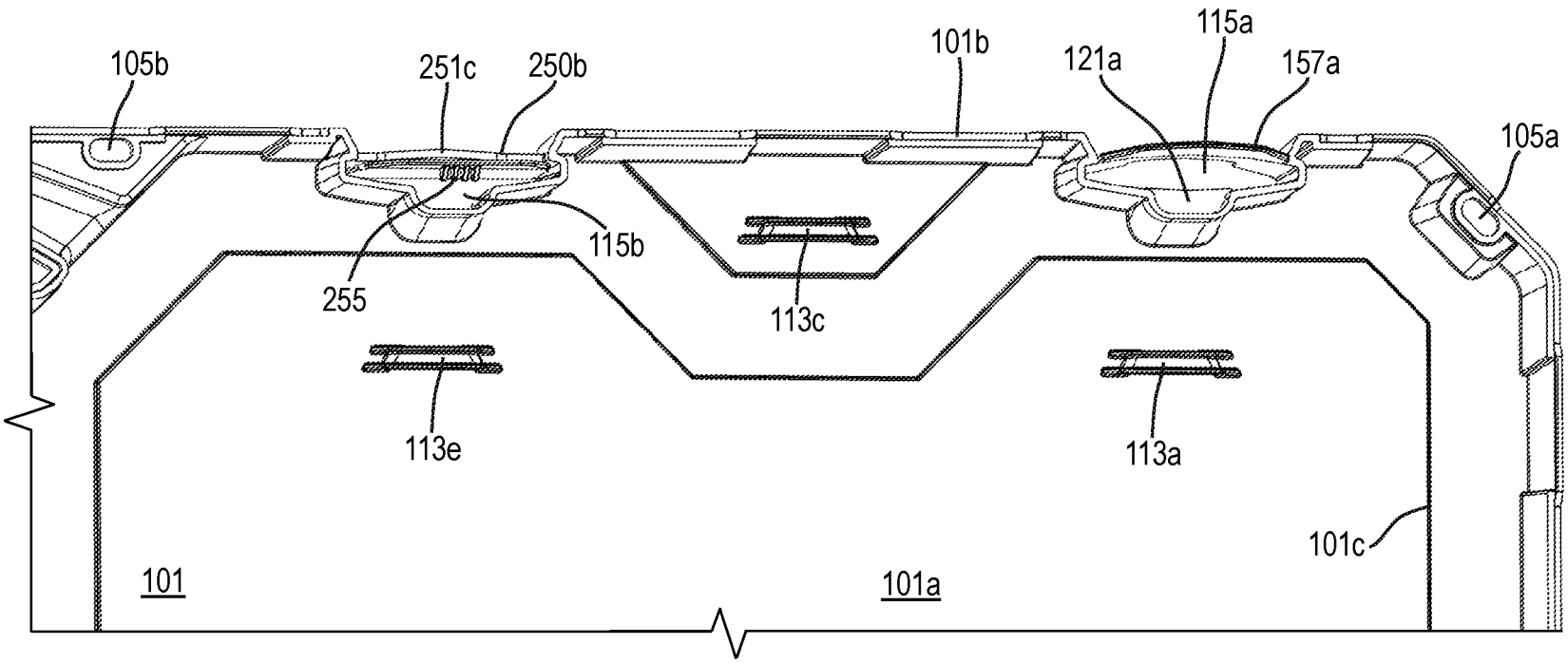
FIG. 14C is a top partial perspective view of a latch member of the storage case assembly of FIG. 13.
Figure 15:
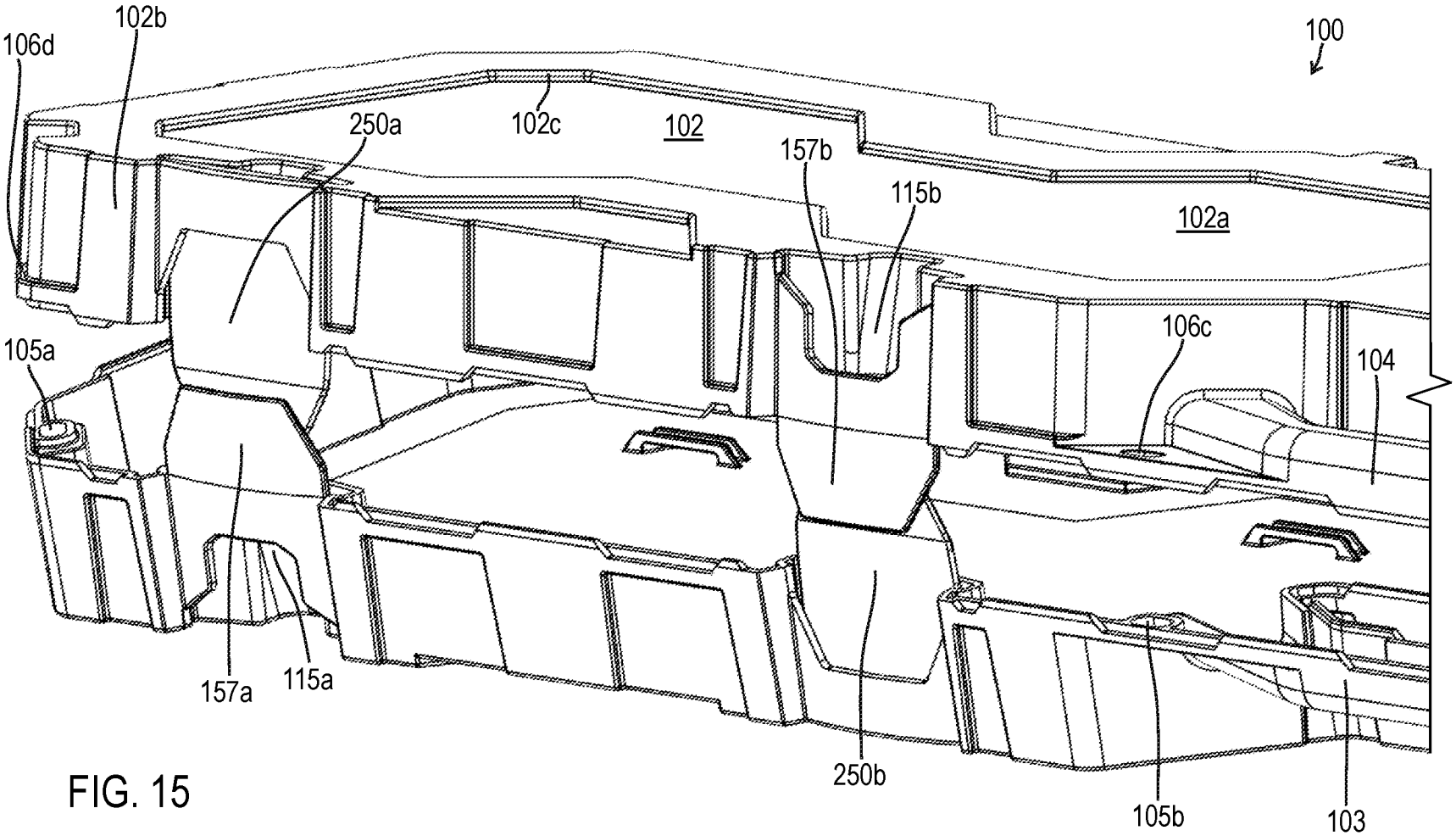
FIG. 15 is an front partial perspective view of the storage case assembly of FIG. 13 in a partially open configuration.
Figure 16:
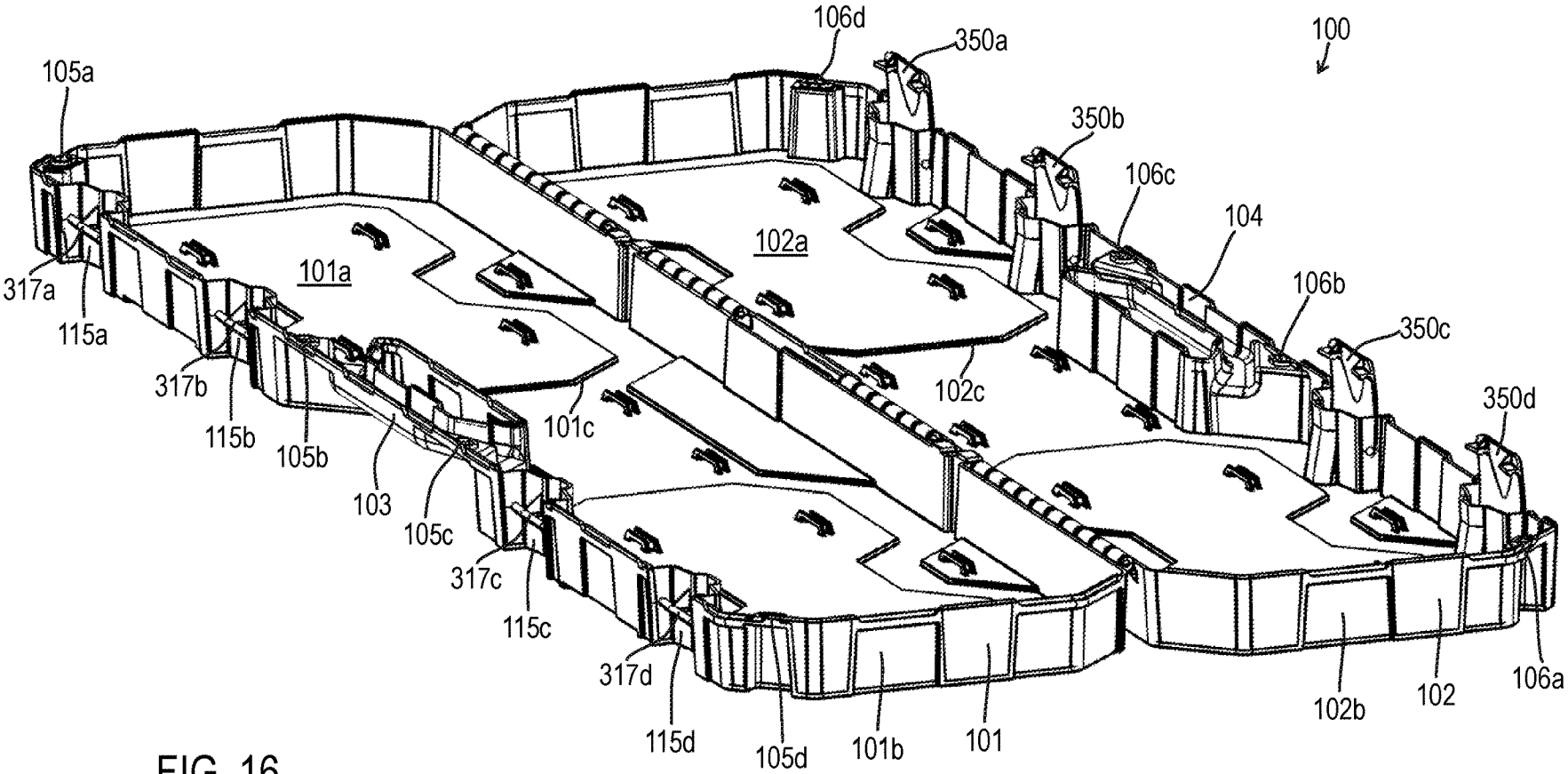
FIG. 16 is a front perspective view of the storage case assembly of FIG. 1 in an open configuration.

As shown in FIGS. 13-15, the storage case assembly 100 may be designed such that at least one latch member 250 is designed to be integral to the first member 101 and/or the second member 102. The latch members 250*b* and 250*d* may be integral to the first member 101 and latch members 250*a* and 250*c* may be integral to the second member 102 (see FIG. 13). Such a design reduces the number of components and equipment necessary for manufacturing the storage case assembly 100. In some cases, when utilizing injection molding, the entire storage case assembly 100 can be manufactured with one mold because the first member 101 and the second member 102 are identical. The storage case assembly 100 may be designed such that each member (i.e., the first member 101 and the second member 102) includes two male latch members 250 and two female receptacles for engaging latch members 250. Each receptacle includes a cavity 115 with an edge 121 that interfaces with a corresponding latch member 250 when in the locked configuration. In addition, the female receptacles may include a flap 157 that covers the latch member 250 when in the locked configuration. In some embodiments, the flap(s) 157 are static and have approximately the same outer profile and/or shape as the latch member 250 on the opposite side of the storage case assembly 100. As shown in FIG. 13, when the storage case assembly 100 is open, each of the latch members 150 and corresponding receptacles have a similar appearance (eight locations total in FIG. 13). As shown in FIGS. 13-15, the storage case assembly 100 may be designed such that the at least one flap 157 is designed to be integral to the first member 101 and/or the second member 102. The flaps 157*a* and 157*c* may be integral to the first member 101 and flaps 157*b* and 157*d* may be integral to the second member 102 (see FIG. 13). Each flap 157 may cover a portion of the cavity 115 including the edge 121 (see FIGS. 13 and 14C). The latch members 250 and flaps 157 may each include a leading edge 251*c* and at least one tapered edge 251*d*. When the storage case assembly 100 closes, the tapered edge(s) 251*d* may guide the two parts of the assembly (i.e., the first member 101 and the second member 102) into alignment with one another. In some embodiments, the tapered edge(s) 251*d* are designed to be approximately 20° to 70° relative to the leading edge 251*c*. In some cases, the tapered edge(s) 251*d* are approximately 30° relative to the leading edge 251*c*. In some cases, the tapered edge(s) 251*d* are approximately 45° relative to the leading edge 251*c*. In some cases, the tapered edge(s) 251*d* are approximately 60° relative to the leading edge 251*c*.

The latch members 250 shown in FIGS. 13-15 may function in a similar manner as latch members 150 illustrated in FIGS. 1 and 3-9B. However, because the latch members 250 are not designed to function in multiple locations and in multiple orientations, the latch members 250 are designed with a single protrusion 255 on the inner surface 251*b* (see FIGS. 14B and 14C). Similar to latch members 150, the latch members 250 engage a corresponding edge 121 within cavity 115 when the latch members 250 are in a locked configuration (e.g., see FIG. 9B as an example of a locked configuration).

As shown in FIGS. 16-19, the storage case assembly 100 may be designed such that at least one latch member 350 is designed to be a separate component from the first member 101 and/or the second member 102. Unlike the latch member 150, the latch member 350 is a cantilever component that pivots about a feature of the first member 101 and/or the second member 102.

Figure 17A:
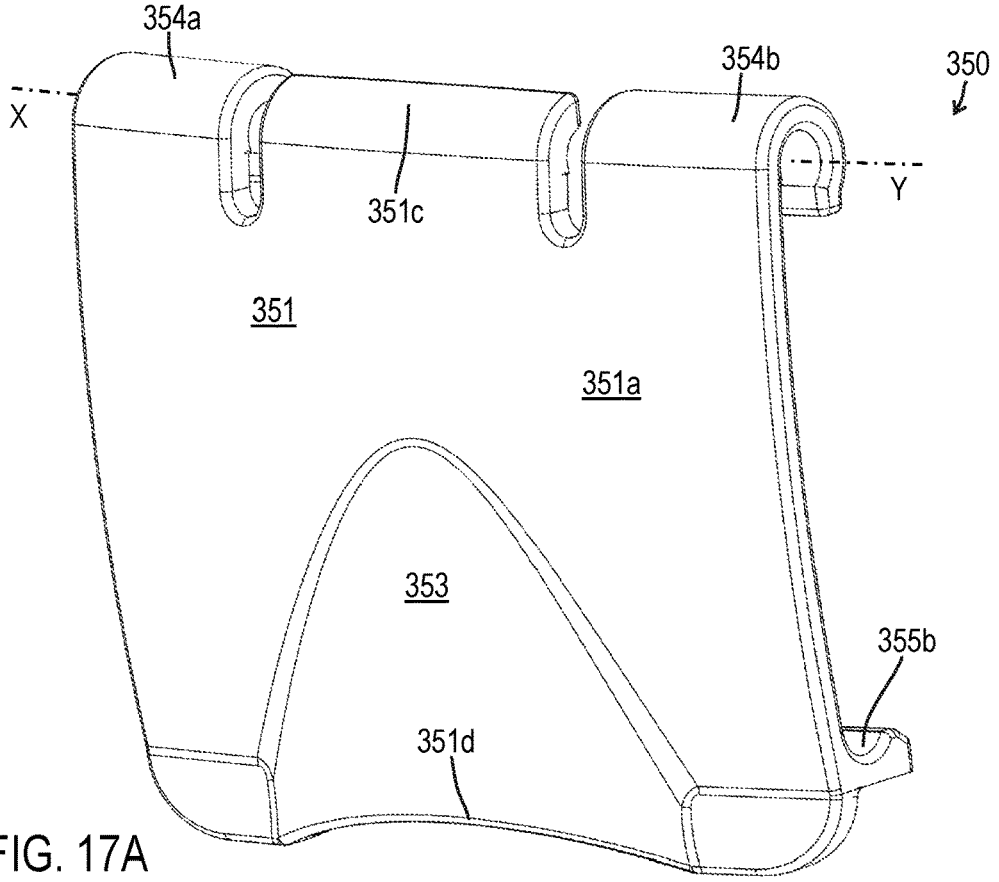
FIG. 17A is a front perspective view of a latch member of the storage case assembly of FIG. 16.
Figure 17B:
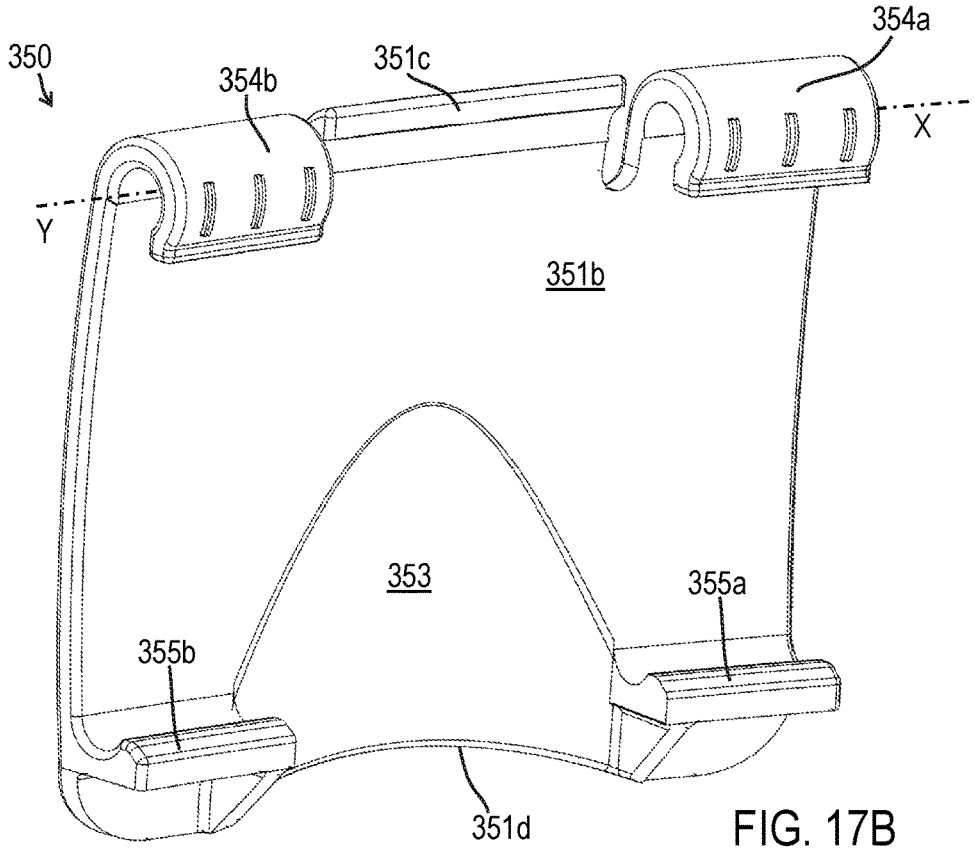
FIG. 17B is a rear perspective view of the latch member of FIG. 17A.
Figure 17C:
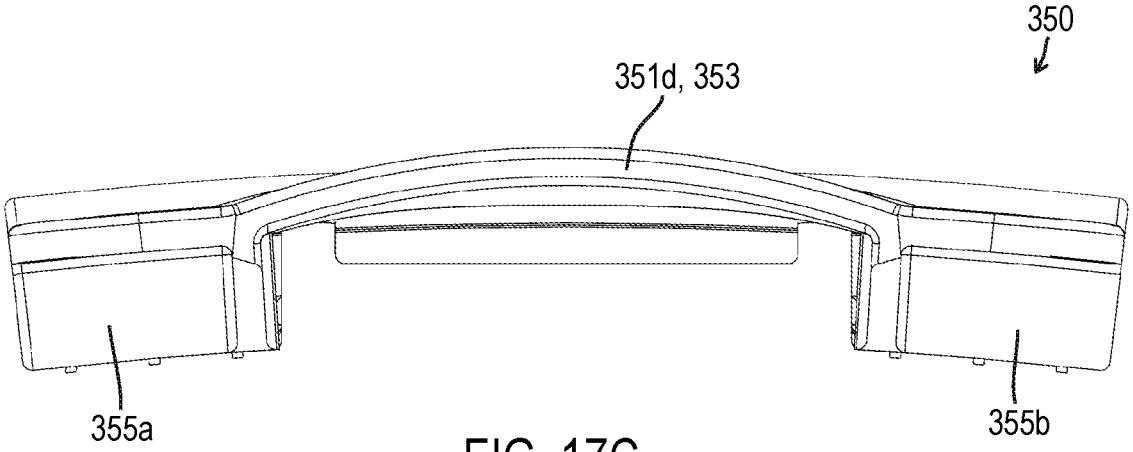
FIG. 17C is a bottom view of the latch member of FIG. 17A.
Figure 17D:
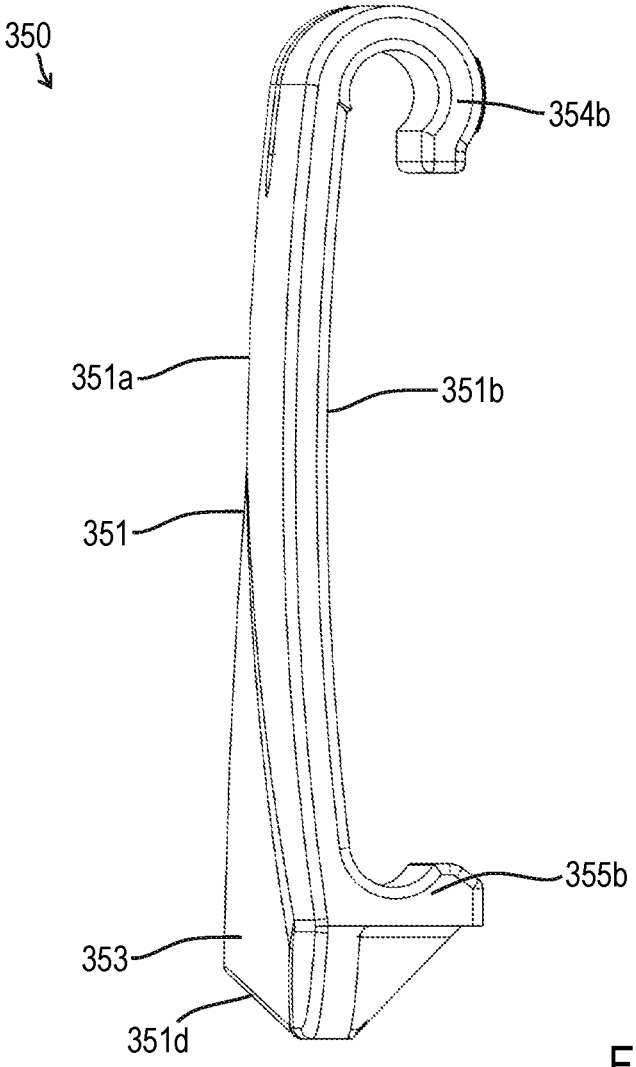
FIG. 17D is a side view of the latch member of FIG. 17A.
Figure 18:
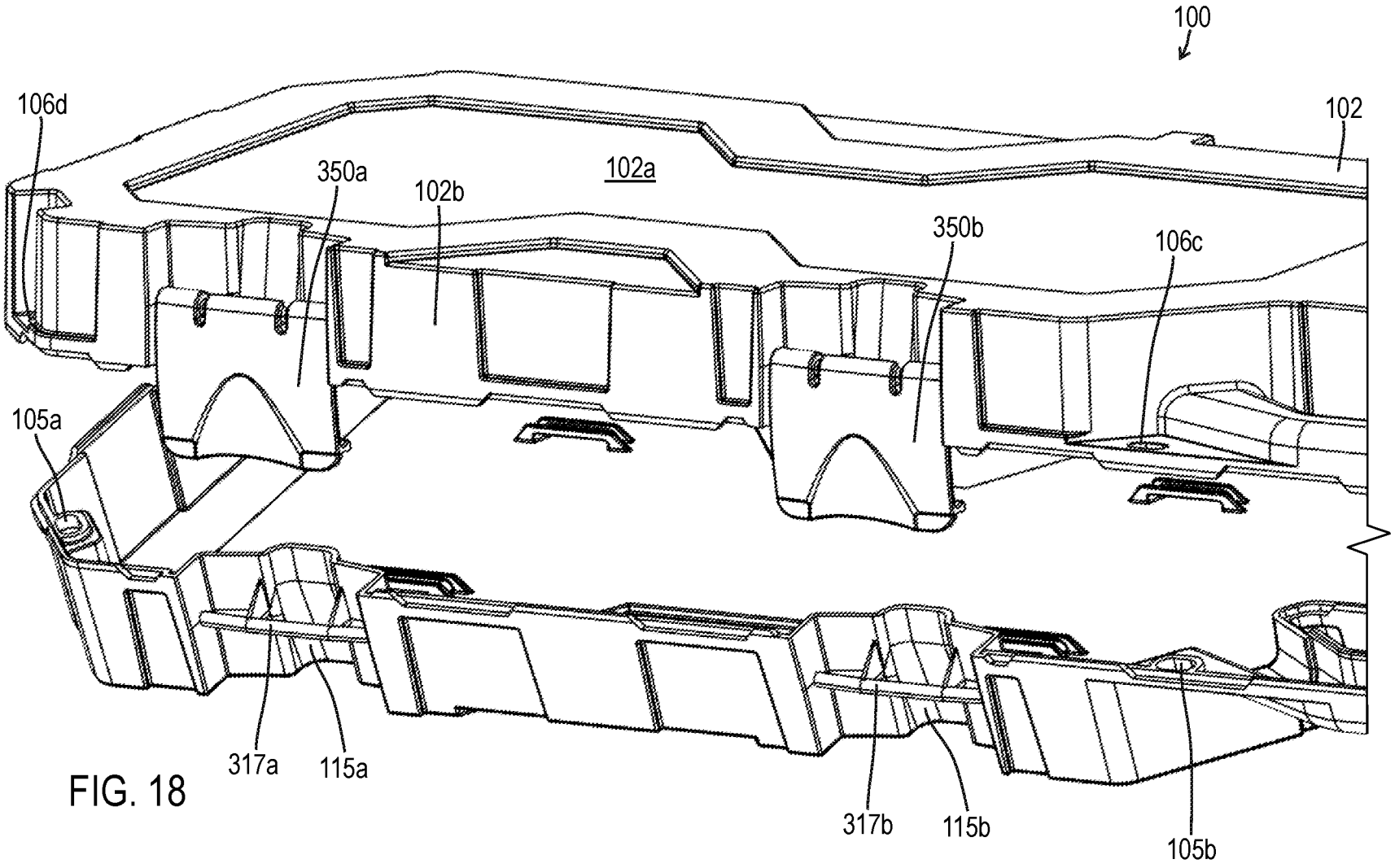
FIG. 18 is an front partial perspective view of the storage case assembly of FIG. 16 in a partially open configuration.
Figure 19:
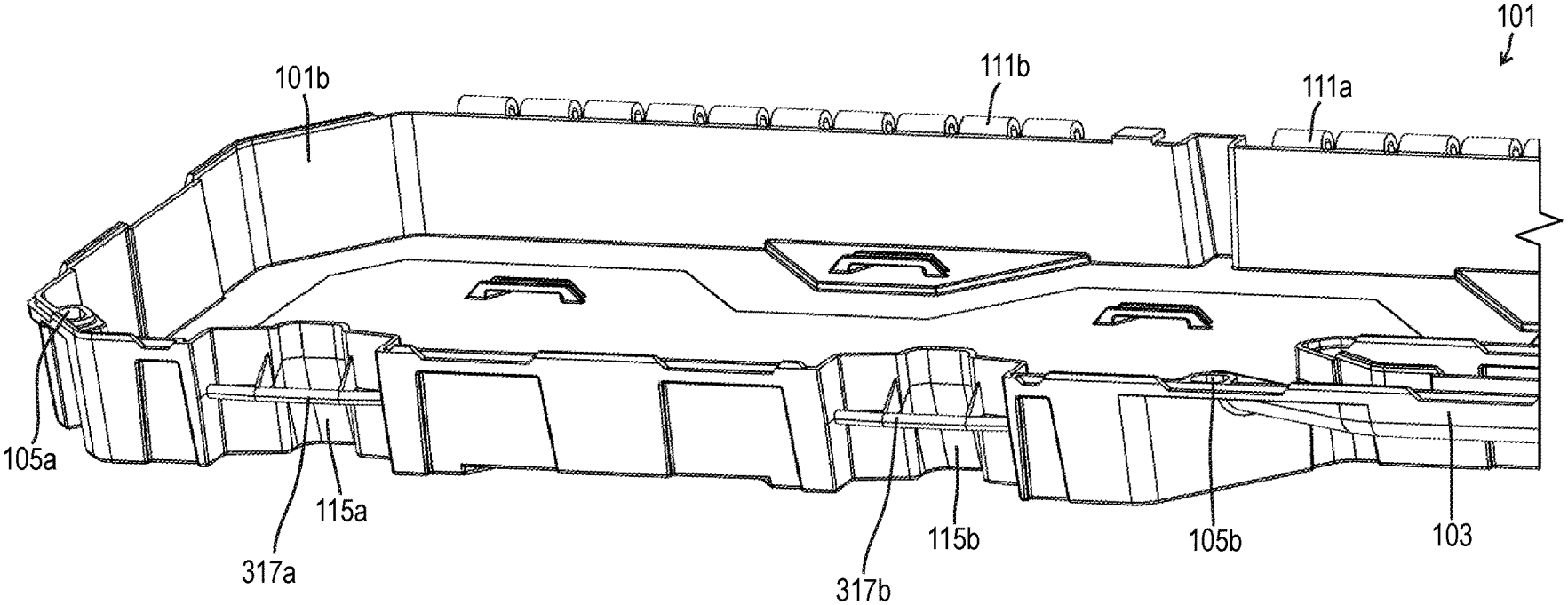
FIG. 19 is an front partial perspective view of a first member of the storage case assembly of FIG. 16.

As shown in FIGS. 17A-17D, each latch member 350 may include a panel portion 351, a contoured portion 353, at least one hinge portion 354, and at least one retainer portion 355. The panel portion 351 may include an outer surface 351*a*, an inner surface 351*b*, an upper edge 351*c*, and a lower edge 351*d*. The contoured portion 353 may curve or protrude outward such that a user can use his/her finger(s) to reach under the lower edge 351*d* and pull the latch member 350 outward such that it pivots about the hinge member(s) 354. In some embodiments, the latch member 350 includes a first hinge member 354*a* and a second hinge member 354*b* such that when the latch member 350 moves, the first hinge member 354*a* rotates about axis X and the second hinge member 354*b* rotates about axis Y. The first member 101 and/or the second member 102 may be designed such that the feature that defines the rotation of the hinge members (e.g., the cross members 317, 318 described below) include curvature such that the axes X, Y follow a curved profile. Axis X and axis Y may be coaxial while in other cases, these axes are not aligned and/or are not parallel with one another. In some embodiments, as shown in FIG. 17B, the latch member 350 may include a first retainer portion 355*a* and a second retainer portion 355*b*.

The first member 101 may include at least one cross member 317 that extends through, adjacent to, and/or near the cavity 115. For example, in embodiments with four cavities 115*a-d*, the first member 101 may include one cross member for each cavity (i.e., cross members 317*a-d*). Similarly, the second member 102 may include a plurality of cross members (e.g., cross members 318*a-d*). In some embodiments, because the first member 101 and the second member 102 are identical (as described above), cross member 317*a* is identical to cross member 318*a*, cross member 317*b* is identical to cross member 318*b*, cross member 317*c* is identical to cross member 318*c*, and cross member 317*d* is identical to cross member 318*d*. The first latch member 350*a* is configured such that the hinge portions 354*a* and 354*b* engage the cross member 318*d* of the second member 102 and (when the storage case assembly 100 is in the closed and fully locked configuration) the retainer portions 355*a* and 355*b* engage the cross member 317*a* of the first member 101. The second latch member 350*b* is configured such that the hinge portions 354*a* and 354*b* engage the cross member 318*c* of the second member 102 and (when the storage case assembly 100 is in the closed and fully locked configuration) the retainer portions 355*a* and 355*b* engage the cross member 317*b* of the first member 101 (see FIG. 20). The third latch member 350*c* is configured such that the hinge portions 354*a* and 354*b* engage the cross member 318*b* of the second member 102 and (when the storage case assembly 100 is in the closed and fully locked configuration) the retainer portions 355*a* and 355*b* engage the cross member 317*c* of the first member 101. The fourth latch member 350*d* is configured such that the hinge portions 354*a* and 354*b* engage the cross member 318*a* of the second member 102 and (when the storage case assembly 100 is in the closed and fully locked configuration) the retainer portions 355*a* and 355*b* engage the cross member 317*d* of the first member 101.

Figure 20:
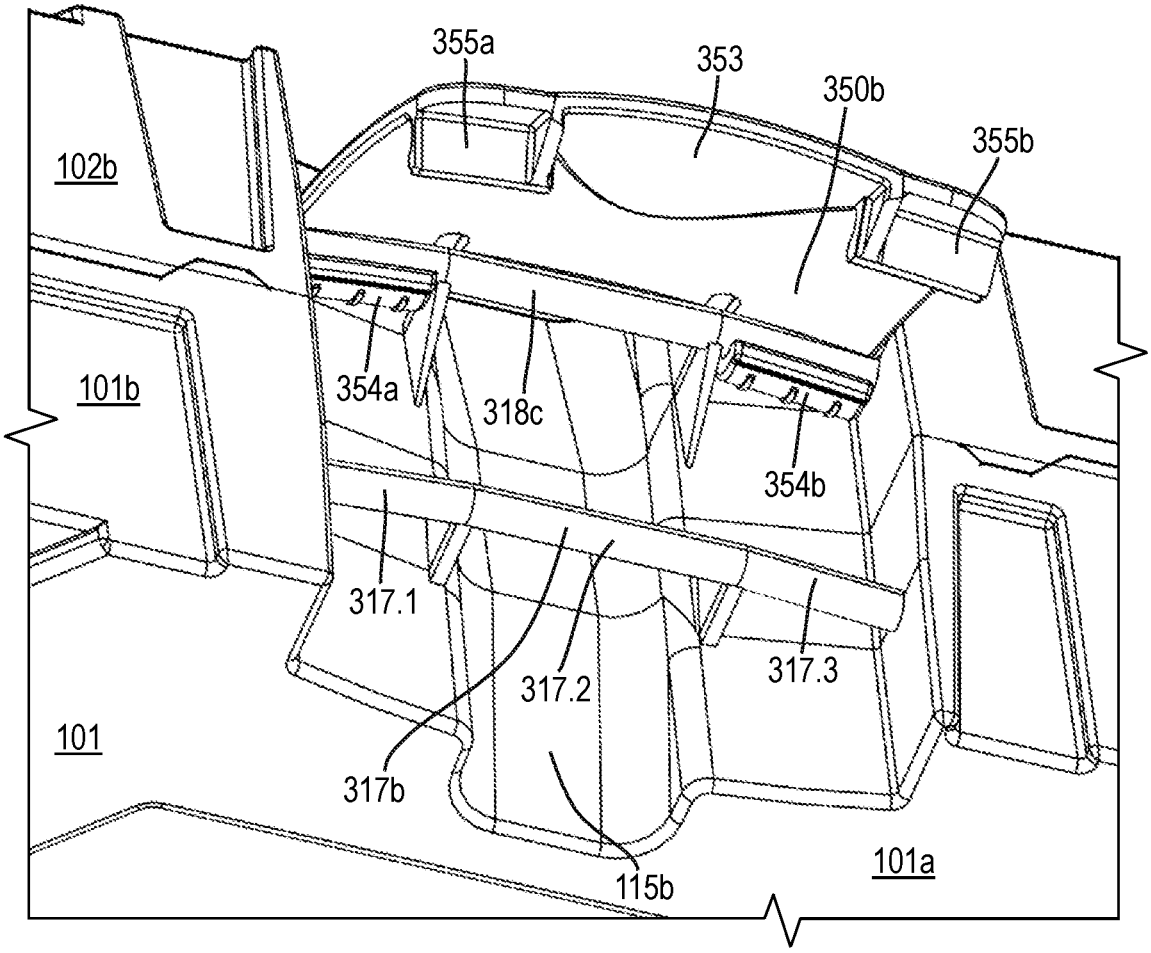
FIG. 20 is a bottom partial perspective view of the storage case assembly of FIG. 16 with a latch member in an unlocked configuration.

In some embodiments, each of the cross members 317, 318 are straight continuous members while in other embodiments, the cross members 317, 318 curve along their respective length. In other cases, each of the cross members 317, 318 include three different segments. For example, as shown in FIG. 20, the cross member 317 may include a first segment 317.1, a second segment 317.2, and a third segment 317.3. In some cases, the three segments each include curvature. In other cases, each segment is straight (no curvature). Each segment may be parallel with one or more of the other segments or may be non-parallel with one or more of the other segments. In some embodiments, the second (center) segment 317.2 is parallel to a longitudinal direction of the storage case assembly 100 (i.e., parallel to the axis of rotation of the hinge members 109-112). The first and third segments 317.1, 317.3 may be angled from their respective connection to the second segment 317.2 toward the interior of the storage case assembly 100 (when viewed from above or below) such that the first and third segments 317.1, 317.3 are symmetric about a center of the cavity 115.

In some cases, when utilizing injection molding, a mold may be designed that is capable of molding the first and second members 101, 102 that are compatible with both the embodiments shown in FIGS. 13-15 and the embodiments shown in FIGS. 16-20. In other words, based on removable/modular features, the mold be modified to create (i) the latch member(s) 250 and flap(s) 157 or (ii) the cross members 317, 318. The latch member(s) 350 may be created using a separate mold.

The components of any of the components described herein may be formed of materials including, but not limited to, thermoplastic, carbon composite, plastic, nylon, polyethylene, polyetherimide, polypropylene, polyvinyl chloride, steel, aluminum, stainless steel, high strength aluminum alloy, other plastic or polymer materials, other metallic materials, other composite materials, or other similar materials. Moreover, the components of the devices described herein may be attached to one another via suitable fasteners, which include, but are not limited to, screws, bolts, rivets, welds, over-molding, co-molding, injection molding, or other mechanical or chemical fasteners.

Different arrangements of the components depicted in the drawings or described above, as well as components and steps not shown or described, are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A storage case assembly comprising:

a first member comprising at least one male hinge member and at least one female hinge member;

a second member comprising at least one male hinge member and at least one female hinge member; and at least one latch member that connects the first member and the second member, wherein:

the at least one latch member comprises a first column at a first lateral edge, a second column at a second lateral edge, an unlocked configuration, and a locked configuration;

the at least one latch member moves from the unlocked configuration to the locked configuration in response to pressure applied to a surface causing the at least one latch member to deflect between the first column and the second column;

the at least one male hinge member of the first member and the at least one male hinge member of the second member each is disposed concentrically within the respective female hinge member such that each male hinge member acts as a hinge axis for the respective female hinge member; and the first member and the second member are identical.

2. The storage case assembly of claim 1, wherein the first member and the second member comprise a polymer material.

3. The storage case assembly of claim 1, wherein:

the at least one male hinge member of the first member engages with the at least one female hinge member of the second member; and the at least one male hinge member of the second member engages with the at least one female hinge member of the first member.

4. The storage case assembly of claim 1, wherein the first column and the second column each comprise an enlarged portion to promote engagement with a corresponding recess of at least one of the first member and the second member.

5. The storage case assembly of claim 4, wherein the enlarged portion comprises a conical transition from a surrounding portion of the corresponding column.

6. The storage case assembly of claim 1, wherein at least one of the first column and the second column comprises a head that engages a respective cavity within a recess of the first member such that the at least one latch member cannot be easily disengaged from the first member.

7. The storage case assembly of claim 1, wherein the at least one latch member comprises at least one protrusion extending from an inner surface.

8. The storage case assembly of claim 7, wherein the at least one protrusion engages a corresponding feature of at least one of the first member and the second member when the at least one latch member is in the locked configuration.

9. The storage case assembly of claim 1, wherein the first member comprises a plurality of strap lugs on an interior surface.

10. The storage case assembly of claim 1, wherein each male hinge member comprises a solid cylindrical portion and each solid cylindrical portion:

fits within a cavity of a corresponding female hinge member; and is approximately concentric with a rotation axis between the first member and the second member.

11. A storage case assembly comprising:

a first member comprising at least one male hinge member and at least one female hinge member;

a second member comprising at least one male hinge member and at least one female hinge member; and at least one latch member that connects the first member and the second member, wherein:

the at least one latch member comprises a panel portion, an upper edge, a lower edge, an unlocked configuration, and a locked configuration;

the at least one latch member moves from the unlocked configuration to the locked configuration in response to pushing the panel portion causing the at least one latch member to deflect inwardly;

the at least one latch member moves from the locked configuration to the unlocked configuration in response to pulling at least one of the upper edge and the lower edge causing the at least one latch member to deflect outwardly;

the at least one male hinge member of the first member engages with the at least one female hinge member of the second member;

the at least one male hinge member of the second member engages with the at least one female hinge member of the first member; and the at least one male hinge member of the first member and the at least one male hinge member of the second member each is disposed concentrically within the respective female hinge member such that each male hinge member acts as a hinge axis for the respective female hinge member.

12. The storage case assembly of claim 11, wherein the first member and the second member comprise a polymer material.

13. The storage case assembly of claim 11, wherein the first member and the second member are identical.

14. The storage case assembly of claim 11, wherein the at least one latch member comprises a first column at a first lateral edge and a second column at a second lateral edge such that the at least one latch member moves from the unlocked configuration to the locked configuration in response to pressure applied to the panel portion causing the at least one latch member to deflect between the first column and the second column.

15. The storage case assembly of claim 14, wherein first column and the second column each comprise an enlarged portion to promote engagement with a corresponding recess of at least one of the first member and the second member.

16. The storage case assembly of claim 11, wherein the at least one latch member comprises at least one protrusion extending from an inner surface.

17. The storage case assembly of claim 16, wherein the at least one protrusion comprises a series of approximately triangular projections.

18. The storage case assembly of claim 16, wherein the at least one protrusion engages a corresponding feature of at least one of the first member and the second member when the at least one latch member is in the locked configuration.

19. The storage case assembly of claim 11, wherein the first member comprises a plurality of strap lugs on an interior surface.

20. The storage case assembly of claim 11, wherein each male hinge member comprises a solid cylindrical portion and each solid cylindrical portion:

fits within a cavity of a corresponding female hinge member; and is approximately concentric with a rotation axis between the first member and the second member.

* * * * *